US012134905B2

(12) United States Patent
Tashima et al.

(10) Patent No.: US 12,134,905 B2
(45) Date of Patent: Nov. 5, 2024

(54) BINDING MACHINE

(71) Applicant: MAX CO., LTD., Tokyo (JP)

(72) Inventors: Nobutaka Tashima, Tokyo (JP); Shinpei Sugihara, Tokyo (JP)

(73) Assignee: Max Co., Ltd., Tokyo (JP)

( * ) Notice: Subject to any disclaimer, the term of this patent is extended or adjusted under 35 U.S.C. 154(b) by 16 days.

(21) Appl. No.: 17/669,803

(22) Filed: Feb. 11, 2022

(65) Prior Publication Data

US 2022/0259875 A1 Aug. 18, 2022

(30) Foreign Application Priority Data

Feb. 15, 2021 (JP) ..... 2021-021732

(51) Int. Cl.
*E04G 21/12* (2006.01)

(52) U.S. Cl.
CPC ..... *E04G 21/123* (2013.01)

(58) Field of Classification Search
CPC ..... B21F 15/04; E04G 21/122; E04G 21/123; B65B 13/025
See application file for complete search history.

(56) References Cited

U.S. PATENT DOCUMENTS

| | | | |
|---|---|---|---|
| 5,558,134 | A | 9/1996 | Miyazaki |
| 2018/0126443 | A1 | 5/2018 | Morijiri et al. |
| 2021/0069772 | A1 | 3/2021 | Morijiri et al. |
| 2021/0197248 | A1 | 7/2021 | Morijiri et al. |
| 2021/0237143 | A1 | 8/2021 | Morijiri et al. |
| 2021/0316428 | A1 | 10/2021 | Morijiri et al. |
| 2021/0317671 | A1 | 10/2021 | Morijiri et al. |
| 2021/0339896 | A1 | 11/2021 | Morijiri et al. |
| 2021/0340781 | A1 | 11/2021 | Morijiri et al. |
| 2021/0396028 | A1 | 12/2021 | Morijiri et al. |

FOREIGN PATENT DOCUMENTS

| | | | | |
|---|---|---|---|---|
| DE | 4439927 | A1 | 5/1995 | |
| EP | 3321450 | A1 * | 5/2018 | ..... B21F 15/04 |
| JP | 2018-076106 | A | 5/2018 | |
| JP | 2020-041399 | A | 3/2020 | |

OTHER PUBLICATIONS

Extended European Search Report dated Jul. 22, 2022, issued by the European Patent Office in the corresponding European Patent Application No. 22156505.4. (7 pages).
Jul. 23, 2024—(JP) Office Action—App 2021-021732.

* cited by examiner

*Primary Examiner* — Debra M Sullivan
(74) *Attorney, Agent, or Firm* — Banner & Witcoff, Ltd.

(57) ABSTRACT

A binding machine includes: a feeding unit configured to feed a wire; a guide part configured to wind the wire fed by the feeding unit around a binding object; a twisting unit configured to twist the wire wound on the binding object by the guide part; and a contact part against which the binding object is butted. The guide part includes: a first guide configured to curl the wire around the binding object butted against the contact part; a second guide configured to guide the wire curled by the first guide to the twisting unit; and an induction part provided to at least one of the first guide and the second guide, and configured to guide the binding object between the first guide and the second guide. The induction part is configured so that a distance between the induction part and the contact part is variable.

21 Claims, 20 Drawing Sheets

BINDING MACHINE

CROSS-REFERENCE TO RELATED APPLICATIONS

This application is based upon and claims the benefit of priority from prior Japanese patent application No. 2021-021732, filed on Feb. 15, 2021, the entire contents of which are incorporated herein by reference.

TECHNICAL FIELD

The present disclosure relates to a binding machine.

BACKGROUND ART

In the related art, used is a binding machine configured to perform a binding operation by inserting a reinforcing bar, which is a binding object, inside a pair of guide parts provided on a tip end-side of a binding machine body, curling a wire and winding the wire around the reinforcing bar by the pair of guide parts and twisting the same.

Here, in order to reliably perform the binding operation, it is necessary to securely insert the reinforcing bar, which is a binding object, into an opening inside the pair of guide parts. In particular, in a binding machine where the binding machine body and a handle part are connected by an elongated connecting part, a structure capable of reliably inserting the reinforcing bar inside the pair of guide parts is required because the guide parts are apart from a viewpoint of an operator.

A related art disclosed in Patent Literature 1 has been suggested to address such an issue. For example, disclosed is a binding machine having an induction part having an inclined surface provided on a tip end-side of a first guide of a guide part and capable of easily inserting a reinforcing bar into an insertion/pulling-out opening between the first guide and a second guide.

Patent Literature 1: JP-A-2020-41399

However, in the binding machine of the related art disclosed in Patent Reference 1 and the like, in a case of performing an operation at a site where a gap between the reinforcing bar that is a binding object and the ground is narrow, when inserting the reinforcing bar into an opening inside the pair of guide parts, there occurs a problem that the tip end-side of the guide part comes into contact with the ground, and therefore, the reinforcing bar cannot be inserted at a predetermined position in the opening between the pair of guide parts.

Therefore, the present invention has been made to solve the above-described problem, and an object thereof is to provide a binding machine capable of inserting a reinforcing bar into an opening between a pair of guide parts even at a site where a gap between a binding object such as a reinforcing bar and the ground is narrow.

SUMMARY OF INVENTION

In order to solve the above-described problem, the present disclosure includes a feeding unit configured to feed a wire, a guide part configured to wind the wire fed by the feeding unit around a binding object, a twisting unit configured to twist the wire wound on the binding object by the guide part, and a contact part against which the binding object is butted, in which the guide part includes a first guide configured to curl the wire around the binding object butted against the contact part, a second guide configured to guide the wire curled by the first guide to the twisting unit, and an induction part provided to at least one of the first guide and the second guide, and configured to guide the binding object between the first guide and the second guide, and in which the induction part is configured so that a distance between the induction part and the contact part is variable.

According to the present disclosure, since the induction part is configured so that the distance between the induction part and the contact part is variable, the binding object can be inserted between the pair of guide parts even when a space between the binding object and the ground is narrow.

DESCRIPTION OF EMBODIMENTS

Hereinafter, favorable embodiments of the present disclosure will be described in detail with reference to the accompanying drawings.

First Embodiment (Configuration Example of Reinforcing Bar Binding Machine 1A)

Figure 1A:
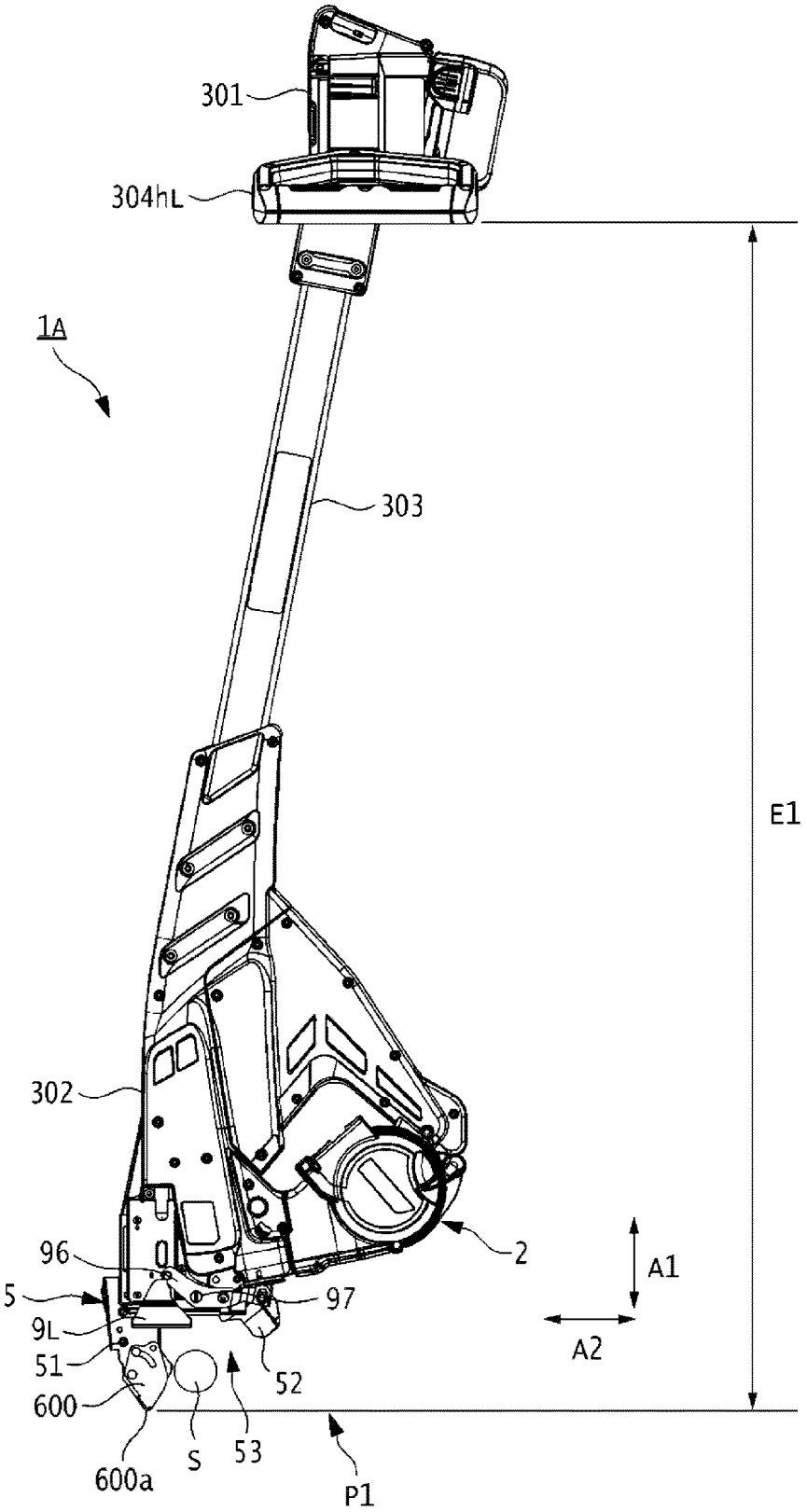
FIG. 1A is a side view of a reinforcing bar binding machine according to a first embodiment.
Figure 1B:
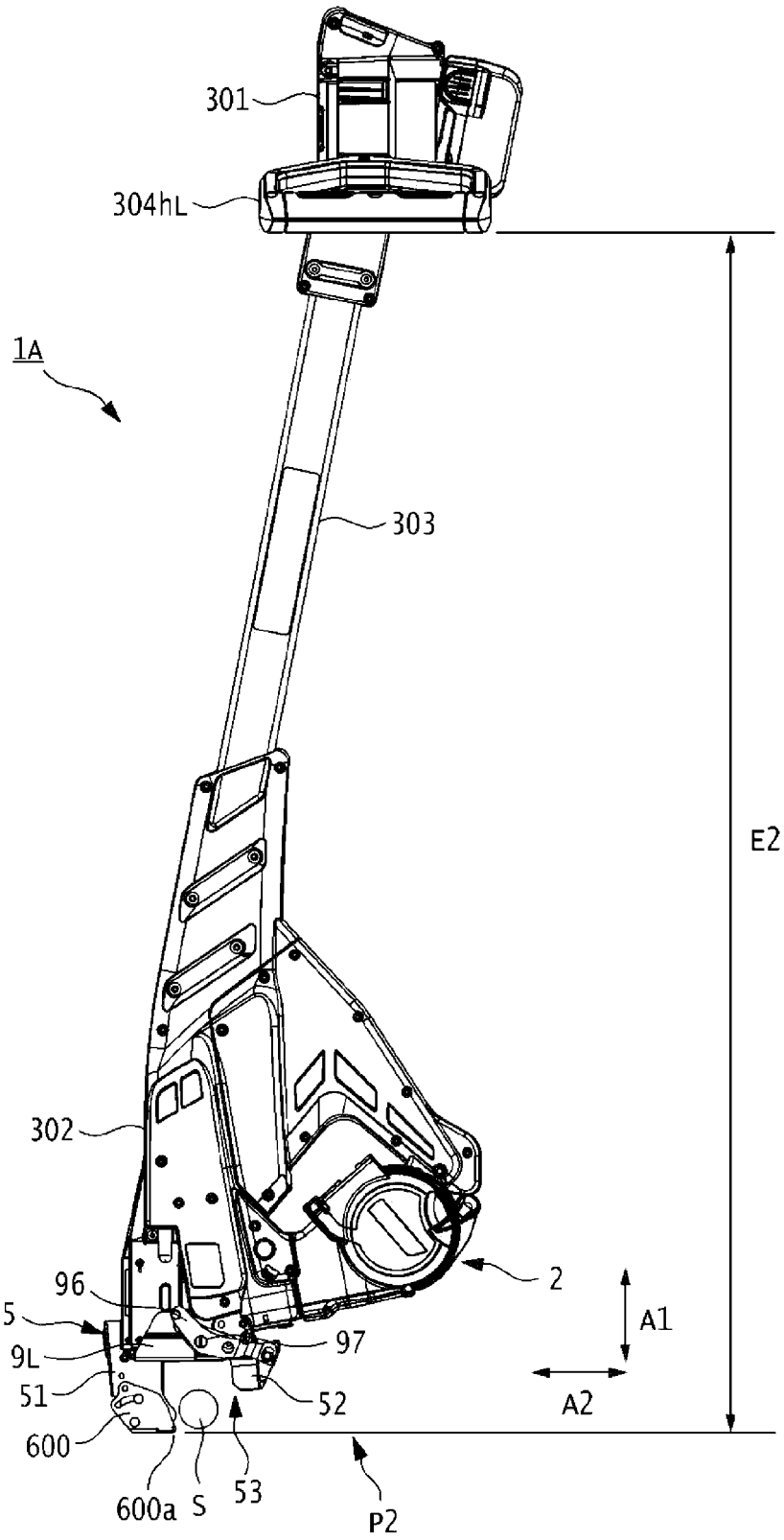
FIG. 1B is a side view of the reinforcing bar binding machine according to the first embodiment.
Figure 1C:
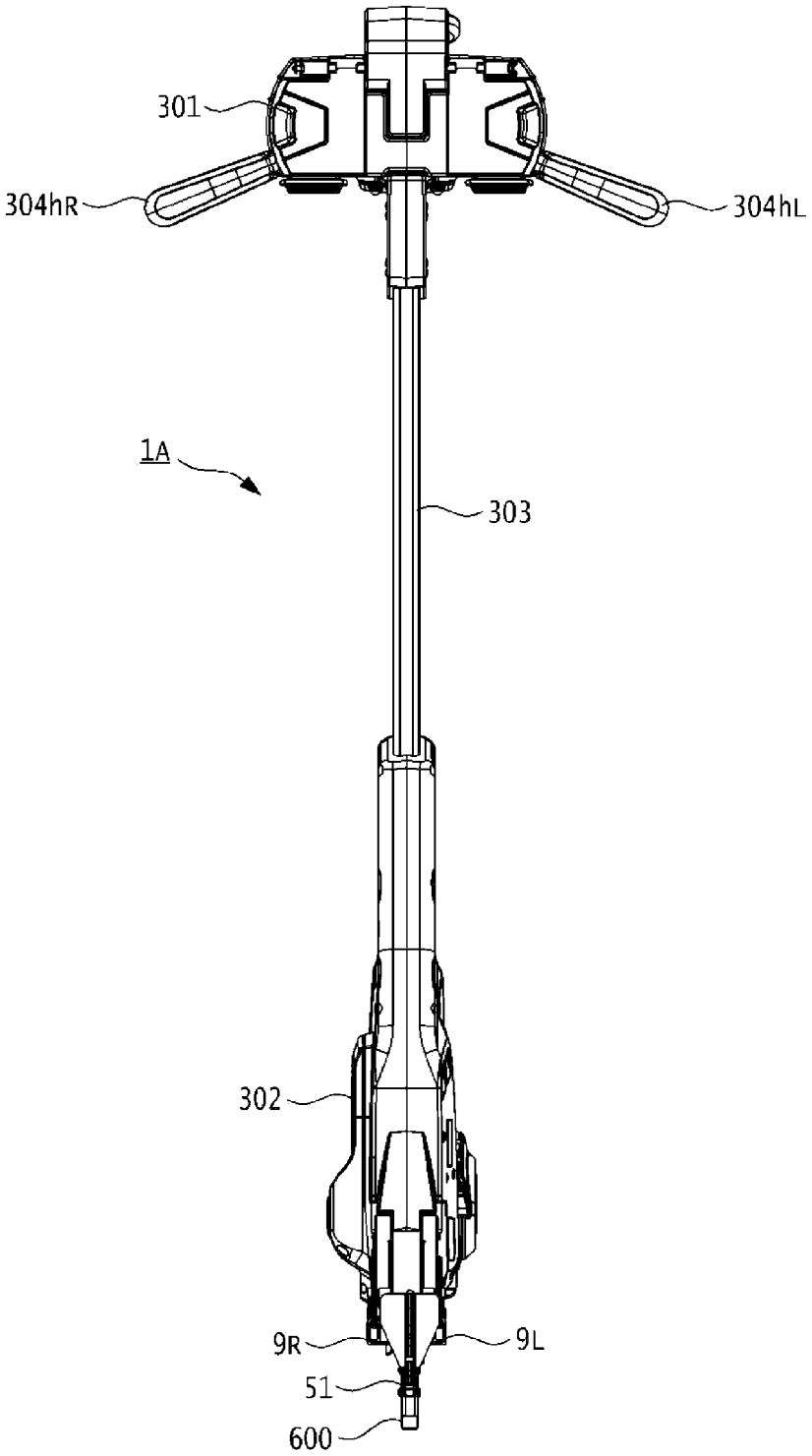
FIG. 1C is a front view of the reinforcing bar binding machine according to the first embodiment.
Figure 2A:
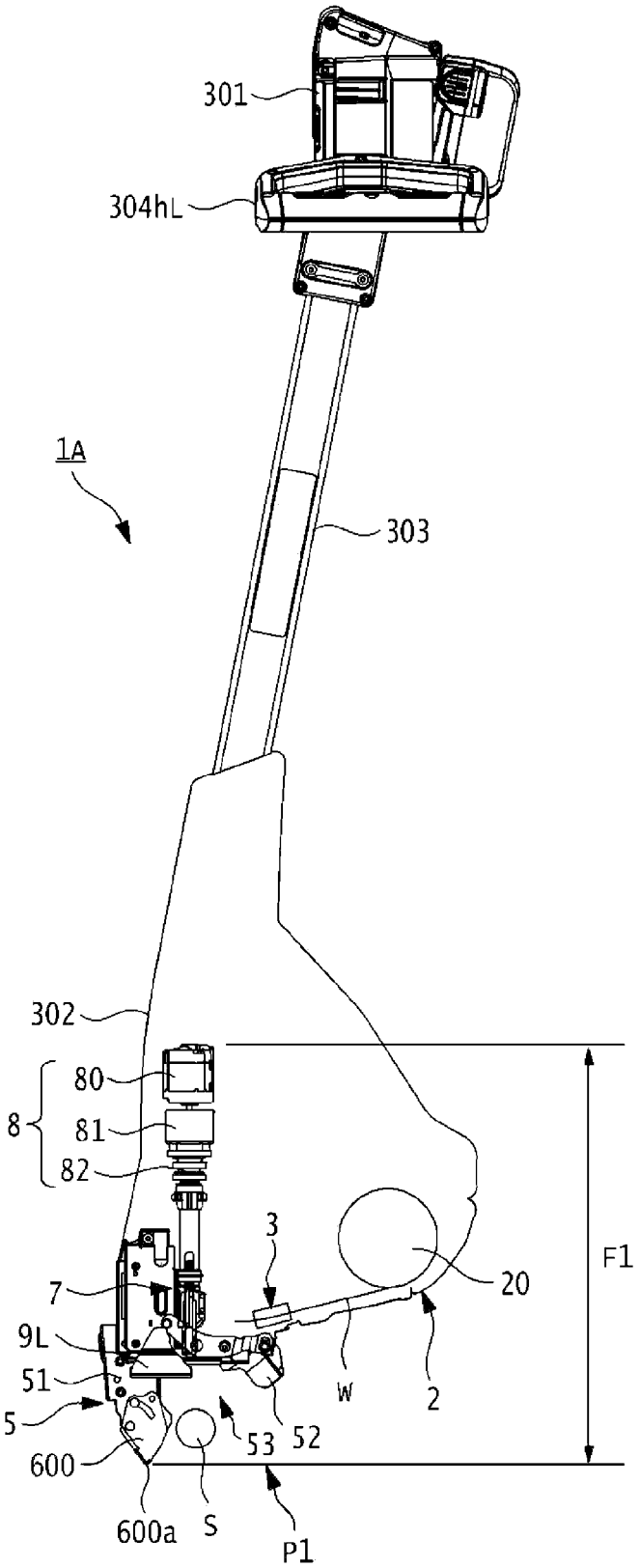
FIG. 2A is a side view showing an internal configuration of the reinforcing bar binding machine according to the first embodiment.
Figure 2B:
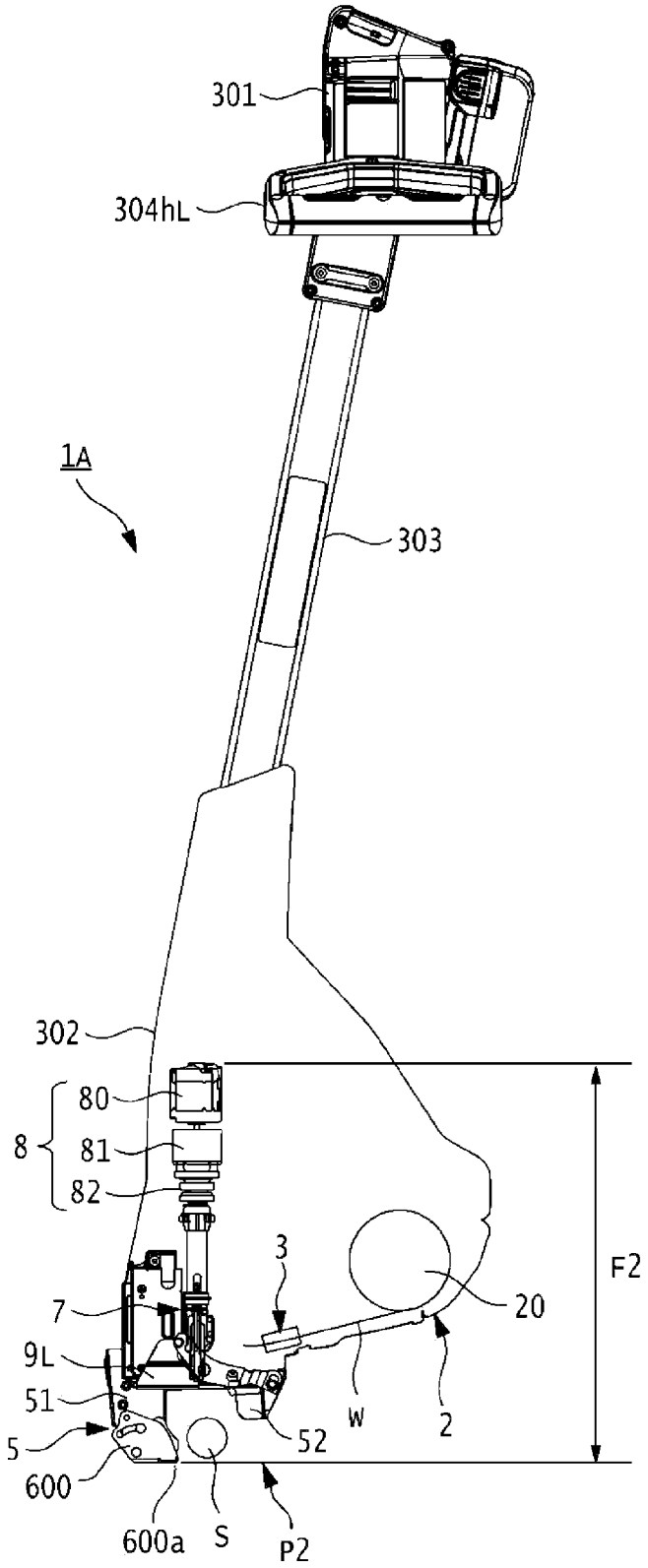
FIG. 2B is a side view showing the internal configuration of the reinforcing bar binding machine according to the first embodiment.
Figure 3:
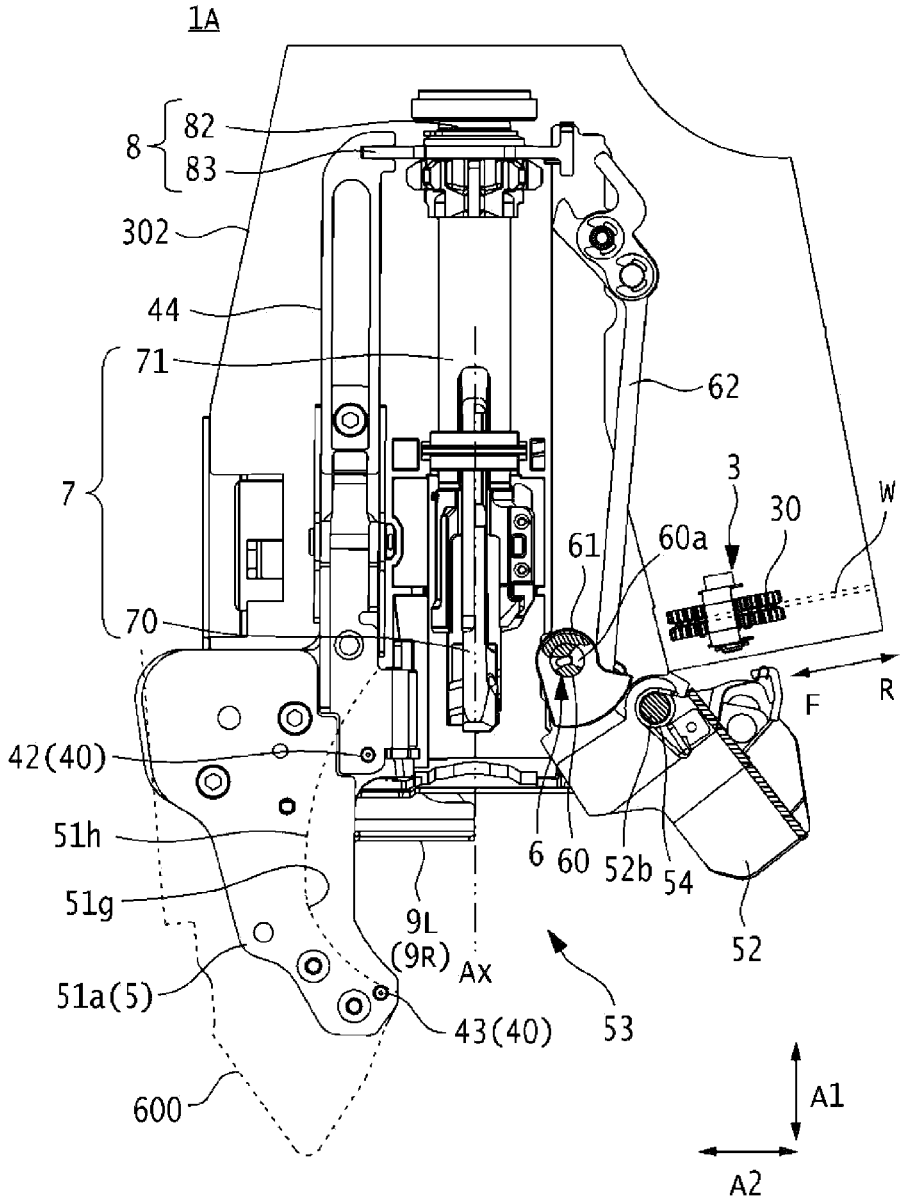
FIG. 3 is a side view showing main parts of the internal configuration of the reinforcing bar binding machine according to the first embodiment.
Figure 4A:
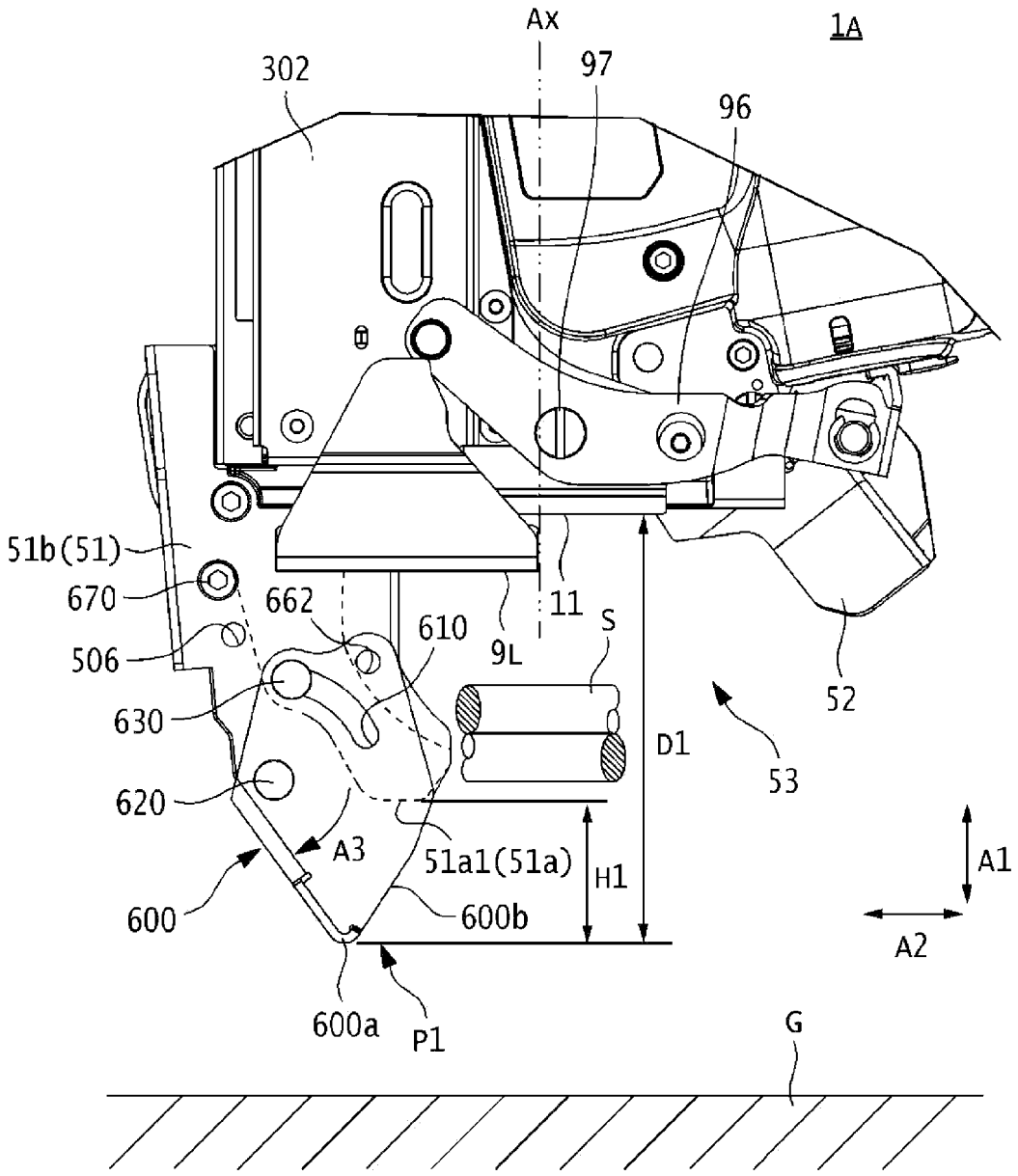
FIG. 4A is a side view of an induction part of the reinforcing bar binding machine according to a first embodiment.
Figure 4B:
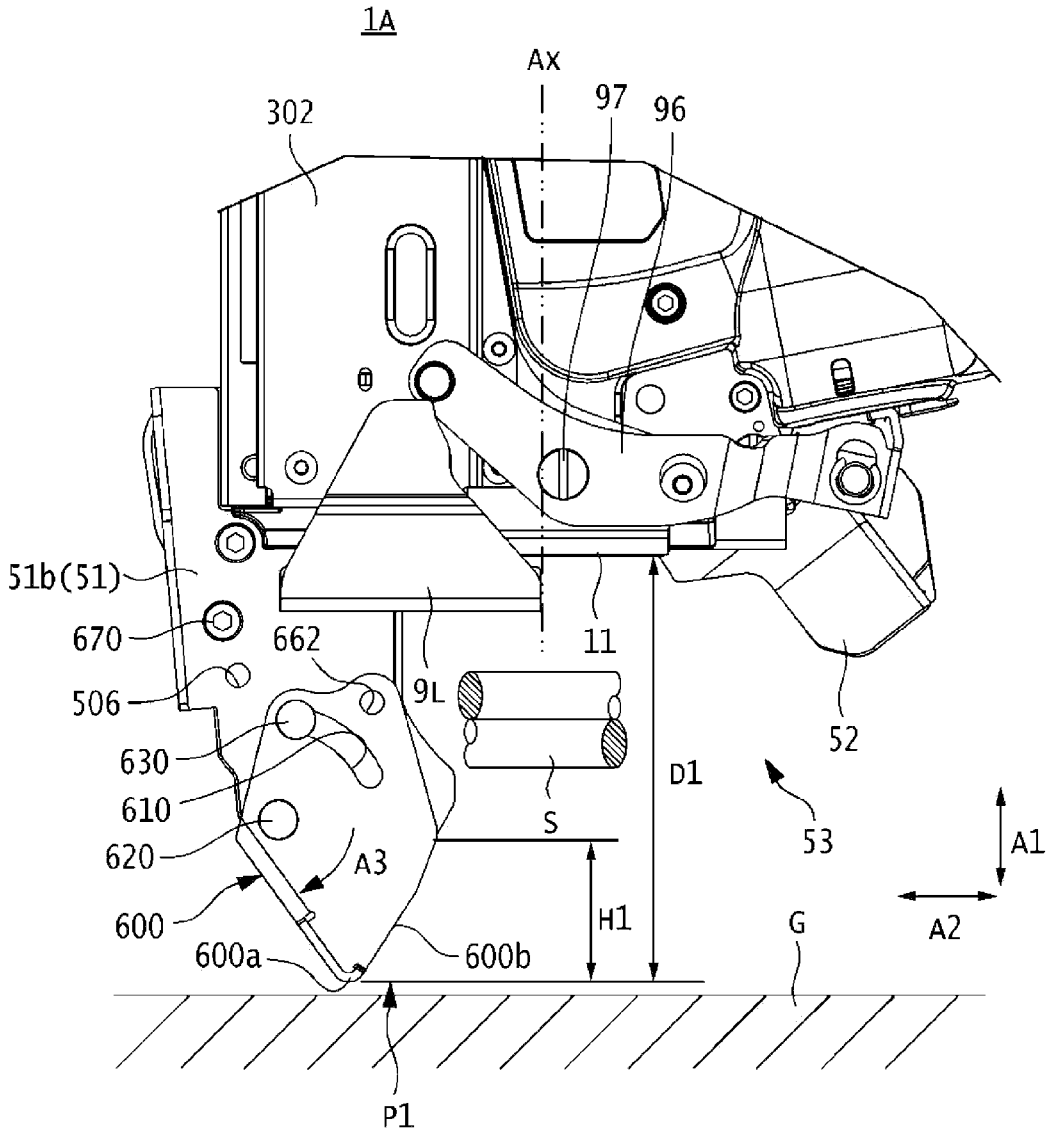
FIG. 4B is a side view of the induction part of the reinforcing bar binding machine according to the first embodiment.
Figure 4C:
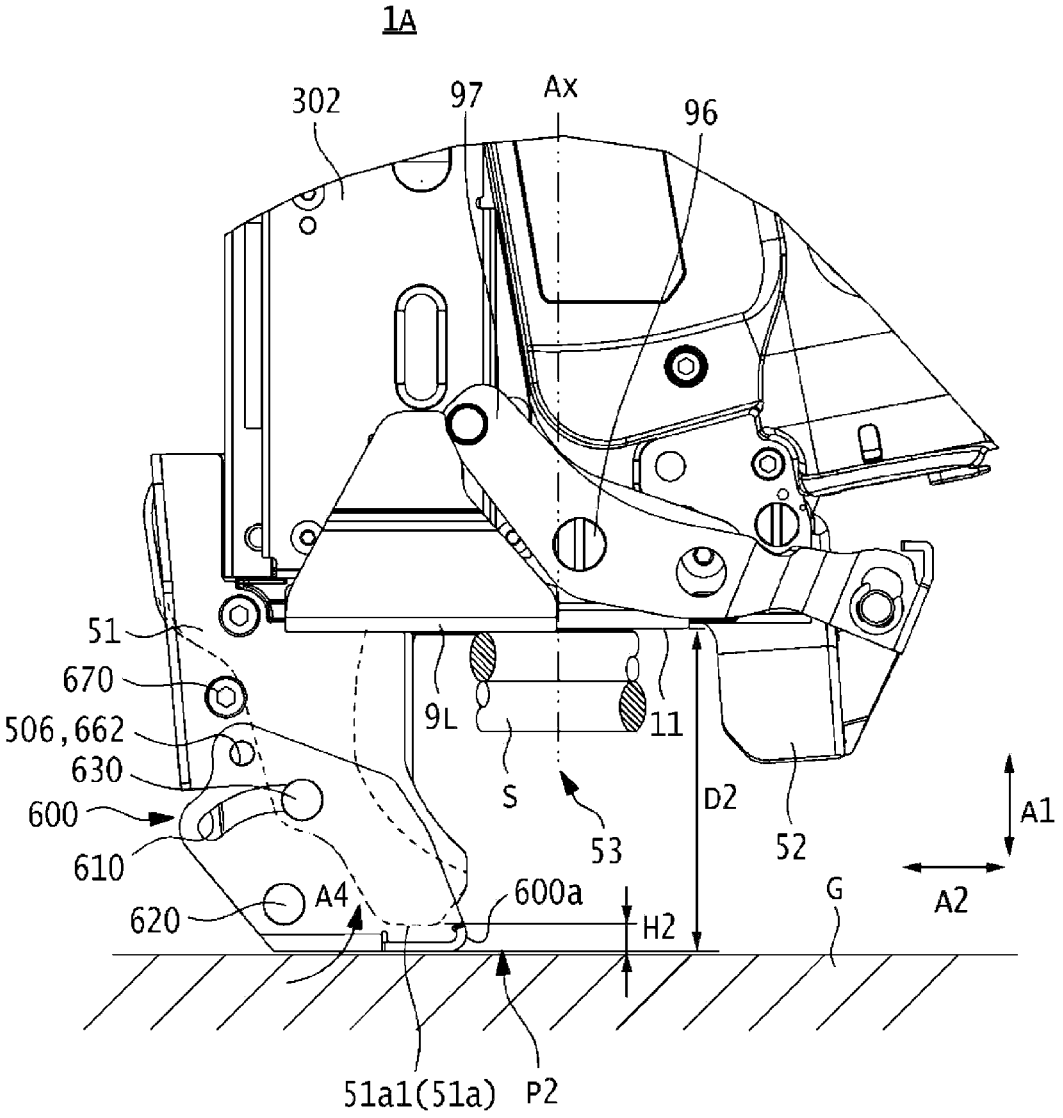
FIG. 4C is a side view of the induction part of the reinforcing bar binding machine according to the first embodiment.
Figure 5:
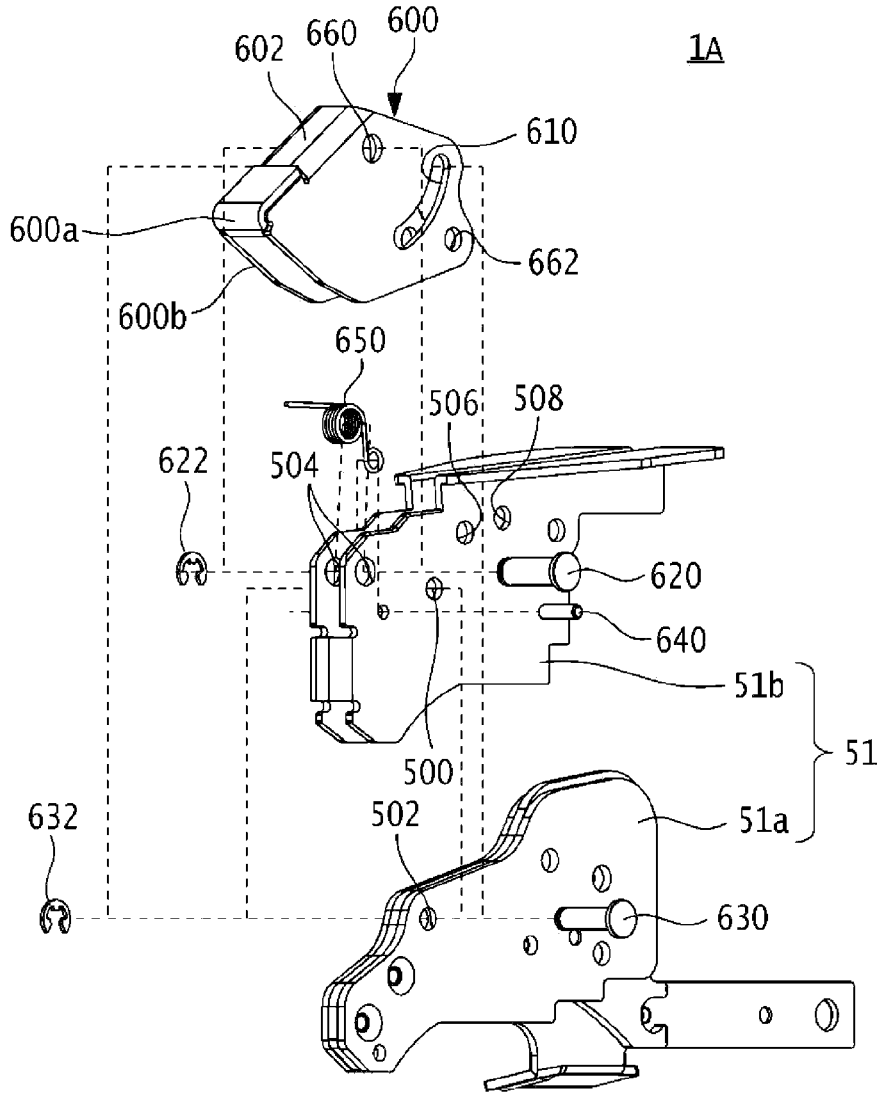
FIG. 5 is an exploded perspective view of the induction part of the reinforcing bar binding machine according to the first embodiment.

FIGS. 1A and 1B are side views of a reinforcing bar binding machine 1A according to a first embodiment. FIG. 1C is a front view of the reinforcing bar binding machine 1A according to the first embodiment. FIGS. 2A and 2B are side views showing an internal configuration of the reinforcing bar binding machine 1A according to the first embodiment, and FIG. 3 is a side view showing main parts of the internal configuration of the reinforcing bar binding machine 1A shown in FIG. 2. FIGS. 4A to 4C are side views showing an example of a configuration of an induction part 600 according to the first embodiment. FIG. 4A shows a case where an operation is performed at a site where a space between a ground G, which is an obstacle, and a reinforcing bar S is wide, and FIG. 4C shows a case where an operation is performed at a site where the space between the ground G, which is an obstacle, and the reinforcing bar S is narrow. FIG. 5 is an exploded perspective view of the induction part 600 according to the first embodiment.

The reinforcing bar binding machine 1A is used in a state where an operator is standing with a guide part 5 facing downward so as to bind a reinforcing bar S at the feet of the operator. As shown in FIGS. 1A to 1C and the like, the reinforcing bar binding machine 1A has a first body part 301 configured so that it can be held by a hand, a second body part 302 having a mechanism for binding the reinforcing bar S with a wire W, and an elongated connecting part 303 configured to connect the first body part 301 and the second body part 302. The first body part 301 has a pair of handle parts 304*h*L and 304*h*R, which are examples of a grip part that can be gripped by the operator. In addition, the first body part 301 is provided with a power supply switch (not shown) for turning off and turning on a power supply of the reinforcing bar binding machine 1A.

As shown in FIGS. 2A and 3 and the like, the second body part 302 includes an accommodation part 2 configured to rotatably accommodate a wire reel 20 on which the wire W is wound, and a feeding unit 3 configured to feed the wire W wound on the wire reel 20 accommodated in the accommodation part 2. In addition, the second body part 302 includes a guide part 5 configured to curl the wire W, which is being fed by the feeding unit 3, around the reinforcing bar S and to guide the curled wire W to a twisting unit 7. Further, the second body part 302 includes a cutting unit 6 configured to cut the wire W, a twisting unit 7 configured to twist the wire W wound around the reinforcing bar S by the guide part 5, and a drive unit 8 configured to drive the cutting unit 6, the twisting unit 7 and the like.

The reinforcing bar binding machine 1A is provided with the guide part 5 on one side of the second body part 302. As for the reinforcing bar binding machine 1A, the first body part 301 and the second body part 302 are connected by the connecting part 303, so that the guide part 5 and the handle parts 304*h*L and 304*h*R are further extended therebetween, as compared to a reinforcing bar binding machine to which the connecting part 303 is not provided. In the present embodiment, a side on which the guide part 5 is provided is defined as a front.

As shown in FIG. 3, the accommodation part 2 is configured so that the wire reel 20 can be attached/detached and supported. The feeding unit 3 includes a pair of feeding gears 30 as a feeding member. The feeding unit 3 is configured to feed the wire W by rotating the feeding gears 30 by a motor (not shown) in a state where the wire W is sandwiched between the pair of feeding gears 30. The feeding unit 3 can feed the wire W in both a forward direction indicated by an arrow F and a reverse direction indicated by an arrow R, according to a rotating direction of the feeding gear 30.

The cutting unit 6 is provided downstream of the feeding unit 3 with respect to feeding of the wire W in the forward direction indicated by the arrow F. The cutting unit 6 includes a fixed blade part 60 and a movable blade part 61 configured to cut the wire W in cooperation with the fixed blade part 60. In addition, the cutting unit 6 includes a transmission mechanism 62 configured to transmit movement of the drive unit 8 to the movable blade part 61.

The fixed blade part 60 has an opening 60*a* through which the wire W passes. The movable blade part 61 is configured to cut the wire W passing through the opening 60*a* of the fixed blade part 60 by a rotating operation about the fixed blade part 60 as a fulcrum.

In addition, as shown in FIGS. 3 and 4A and the like, the guide part 5 is configured to wind the wire W fed by the feeding unit 3 around the reinforcing bar S. The guide part 5 includes a first guide 51 configured to curl and guide the wire W around the reinforcing bar S that is butted against a contact part 11, which will be described later, a second guide 52 configured to guide the wire W curled by the first guide 51 to the twisting unit 7, and an induction part 600 configured to guide the reinforcing bar S to an insertion/pulling-out opening (opening) 53. Note that, the details of the induction part 600 will be described later.

The first guide 51 is attached to an end portion on a front side of the second body part 302 and extends in a first direction, which is a front and rear direction indicated by an arrow A1. When a side of the first guide 51 attached to the second body part 302 is referred to a base end-side and a side extending forward from the second body part 302 is referred to as a tip end-side, the base end-side is attached to the second body part 302 by a screw or the like. Further, the first guide 51 has a groove portion 51*h* having a guide surface 51*g* with which the wire W fed by the feeding unit 3 is to come into sliding contact.

The first guide 51 has a regulation part 40. The regulating part 40 has a first regulation member constituted by the fixed blade part 60 described above. In addition, the regulating part 40 has a regulation member 42 provided downstream of the fixed blade part 60 and a regulation member 43 provided downstream of the regulation member 42 with respect to the feeding of the wire W in the forward direction indicated by the arrow F. The regulation member 42 and the regulation member 43 are constituted by columnar members, and the wire W comes into contact with outer peripheral surfaces thereof. Thereby, the wire W fed by the feeding unit 3 passes while being in contact with the fixed blade part 60, the regulation member 42, and the regulation member 43, so that the wire W is curled.

The regulation part 40 includes a transmission mechanism 44 configured to transmit movement of the drive unit 8 to the regulation member 42. The regulation member 42 is located at a position where the wire W comes into contact with the same when feeding the wire W in the forward direction by the feeding unit 3 to curl the wire W, and is configured to be movable to a position where it is not in contact with the wire W by an operation of feeding the wire W in the reverse direction to wind the wire W on the reinforcing bar S.

The second guide 52 is attached to an end portion on the front side of the second body part 302. The second guide 52 is provided to face the first guide 51 in a second direction indicated by an arrow A2, which is an upper and lower direction orthogonal to the first direction. A predetermined space is provided between the first guide 51 and the second guide 52 along the second direction, and an insertion/pulling-out opening 53 to and from which the reinforcing bar S is inserted and pulled out is formed between the first guide 51 and the second guide 52.

The second guide 52 is configured to be rotatable with respect to the second body part 302 with a shaft 52*b* as a fulcrum. The second guide 52 is configured to be movable in directions toward and away from the first guide 51 in the second direction indicated by the arrow A2.

The second guide 52 is configured to be movable between an open position opening with respect to the first guide 51 and a closed position closer to the first guide 51 than the open position by rotation with the shaft 52*b* as a fulcrum, in conjunction with a pair of contact members 9L and 9R. When the second guide 52 is at the open position, a space between the first guide 51 and the second guide 52 is widened, so that it becomes easier to insert the reinforcing bar into the insertion/pulling-out opening 53. The second guide 52 is urged by an urging member 54 constituted by a torsion coil spring or the like in a direction of moving to the open position, and a state of being moved to the open position is maintained.

As shown in FIG. 3, the twisting unit 7 includes an engaging part 70 with which the wire W is engaged and an actuating part 71 configured to actuate the engaging part 70. The engaging part 70 is formed with a first passage through which the wire W fed to the cutting unit 6 by the feeding unit 3 passes, and a second passage through which the wire W curled by the regulation part 40 and guided to the twisting unit 7 by the guide part 5 passes. The engaging part 70 is configured to rotate by an operation of the actuating part 71, thereby twisting the wire W wound on the reinforcing bar S.

As shown in FIGS. 2A and 3 and the like, the drive unit 8 includes a twisting motor 80 configured to drive the twisting unit 7 and the like, a decelerator 81 configured to perform deceleration and torque amplification, a rotary shaft 82 configured to drive and rotate via the decelerator 81 by the twisting motor 80, and a moving member 83 configured to transmit a drive force to the cutting unit 6 and the regulation member 42. In the twisting unit 7 and the drive unit 8, rotation centers of the rotary shaft 82 and the actuating part 71 and engaging part 70 are arranged coaxially. The rotation centers of the rotary shaft 82 and the actuating part 71 and engaging part 70 are referred to as 'axis line Ax'. In the present example, the first direction indicated by the arrow A1 is a direction along the axis line Ax.

The drive unit 8 is configured to move the actuating part 71 along an axial direction of the rotary shaft 82 by a rotating operation of the rotary shaft 82. As the actuating part 71 moves along the axial direction of the rotary shaft 82, the engaging part 70 holds a tip end-side of the wire W guided to the twisting unit 7 by the guide part 5.

In the drive unit 8, the moving member 83 is configured to move along the axial direction of the rotary shaft 82 in conjunction with an operation of the actuating part 71 moving along the axial direction of the rotary shaft 82, so that movement of the moving member 83 is transmitted to the regulation member 42 by the transmission mechanism 44 and the regulation member 42 moves to a position where it is not in contact with the wire. In addition, when the actuating part 71 moves along the axial direction of the rotary shaft 82, the movement of the moving member 83 is transmitted to the movable blade part 61 by the transmission mechanism 62, so that the movable blade part 61 is actuated to cut the wire W.

The drive unit 8 is configured to rotate the actuating part 71, which has been moved along the axial direction of the rotary shaft 82, by the rotating operation of the rotary shaft 82. The actuating part 71 is configured to rotate around an axis of the rotary shaft 82, thereby twisting the wire W with the engaging part 70.

Further, the reinforcing bar binding machine 1A includes contact members 9L and 9R, a link member 96, and a contact part 11.

As shown in FIGS. 1 and 2A and the like, the contact members 9L and 9R are configured to come into contact with the reinforcing bar S, which is a binding object inserted into the insertion/pulling-out opening 53 between the first guide 51 and the second guide 52. The contact member 9L is provided on one side of the second body part 302, and the contact member 9R is provided on the other side of the second body part 302. The contact members 9L and 9R are provided to be movable along the first direction indicated by the arrow A1, and are configured to move between a standby position (refer to FIG. 4B) protruding from the contact part 11 toward the insertion/pulling-out opening 53 and an actuating position (refer to FIG. 4C) close to the contact part 11, at which the second guide 52 is moved to the closed position.

The link member 96 is configured to transmit movement of the contact members 9L and 9R to the second guide 52. When the contact members 9L and 9R are moved to the actuating position, the link member 96 rotates about a shaft 97 as a fulcrum to move the second guide 52 to the closed position where an opening width of the insertion/pulling-out opening 53 is narrowed.

The contact part 11 is attached from an end portion on the front side of the second body part 302 to both left and right sides of the second body part 302, and is configured to cover the end portion on the front side of the second body part 302. When the contact members 9L and 9R pushed by the reinforcing bar S inserted into the insertion/pulling-out opening 53 are moved to the actuating position, the reinforcing bar S or the like is butted against the contact part 11. The contact part 11 is constituted by a metal plate or the like, and has a shape to cover a portion or all of the end portion on the front side of the second body part 302 and portions of both the left and right sides on the front side of the second body part 302, between the base end-side of the first guide 51 and the base end-side of the second guide 52. While the second body part 302 is made of resin, the contact part 11 is made of metal, so that even when the contact members 9L, 9R and the reinforcing bar S are butted against the contact part 11, the wear of the contact part 11 can be reduced.

(Configuration Example of Induction Part 600)

Next, an example of a configuration of the induction part 600 according to the first embodiment is described.

As shown in FIG. 4A and the like, the induction part 600 is provided on the tip end-side of the first guide 51, and is configured to pick up the reinforcing bar S to be bound, and to induce and guide the same into the insertion/pulling-out opening 53 between the first guide 51 and the second guide 52. The induction part 600 has a tip end portion 600*a* provided to be in contact with a ground G, and an induction surface 600*b* provided on a side (the insertion/pulling-out opening 53-side) facing the second guide 52. The tip end portion 600*a* is formed in a curved shape, for example, instead of an edge shape so as not to damage a floor surface or the like at an operation site. The induction surface 600*b* is inclined so that an opening width of the insertion/pulling-out opening 53 becomes wider from the base end-side toward the tip end-side of the induction part 600, and has such a shape that it is easy to pick up the reinforcing bar S.

Further, the induction part 600 is configured to rotate as the tip end portion 600*a* presses against the ground G and to vary an amount of protrusion with respect to the first guide 51 when performing an operation at a site where a space between the ground G, which is an obstacle, and the reinforcing bar S is narrow. That is, the induction part 600 is configured so that a distance between the induction part and the contact part 11 of the second body part 302 can be varied according to the space between the reinforcing bar S, which is a binding object, and the ground G.

Specifically, as shown in FIG. 4A, in a case of performing an operation at a site where the space between the reinforcing bar S and the ground G is wide, the induction part 600 is located at a first position P1 where a distance between the tip end portion 600*a* and the contact part 11 is a first distance D1, and an amount of protrusion of the induction part 600 with respect to the first guide 51 becomes large. In contrast, as shown in FIG. 4C, in a case of performing the operation at a site where the space between the reinforcing bar S and the ground G is narrow, the induction part 600 is rotated to a second position P2 where the distance between the tip end portion 600*a* and the contact part 11 is a second distance D2 shorter than the first distance D1, and the amount of protrusion of the induction part 600 with respect to the first guide 51 becomes small.

As shown in FIG. 5, the induction part 600 is constituted by, for example, a pair of flat plates arranged to face each other, and is fitted to an outer side of a guide cover 51*b*. Similar to the induction part 600, the guide cover 51*b* is also constituted by, for example, a pair of flat plates arranged to face each other, and is fitted to an outer side of a guide arm 51*a*. Note that, the guide arm 51*a* and the guide cover 51*b* constitute the first guide 51.

The induction part 600 is formed with a long hole 610 for movably guiding the same between the first position P1 and the second position P2. The long hole 610 is formed in a substantial arc shape, and is configured to regulate a moving range of the induction part 600 between the first position P1 and the second position P2.

A pin 630 is inserted into the long hole 610 of the induction part 600, a hole 500 of the guide cover 51*b*, and a hole 502 of the guide arm 51*a*, from one side toward the other side. A stopper 632 for preventing the pin 630 from coming off in the axial direction is attached to the other end portion of the pin 630. Further, a pin 640 for supporting a torsion coil spring 650, which will be described later, is attached between the plates of the guide cover 51*b*.

A pin 620 is inserted into a hole 660 of the induction part 600 and a hole 504 of the guide cover 51*b*, from one side toward the other side. A stopper 622 for preventing the pin 620 from coming off in the axial direction is attached to the other end portion of the pin 620. The induction part 600 is configured to rotate along the long hole 610 with respect to the guide cover 51*b* (first guide 51) about the pin 620 as a fulcrum. The tip end portion 600*a* is provided on the insertion/pulling-out opening 53-side with respect to the pin 620 that is a fulcrum of rotation.

A torsion coil spring 650 is provided between the plates of the guide cover 51*b*. The pin 620 is inserted into a central axis of the torsion coil spring 650, a fixed point of the torsion coil spring 650 is attached to the pin 640, and a load point of the torsion coil spring 650 is in contact with an acting portion 602 provided on an opposite side of the induction surface 600*b*. The induction part 600 is urged by the torsion coil spring 650 in a direction of an arrow A3 in a clockwise direction (refer to FIG. 4B) with the pin 620 as a fulcrum, and is maintained at the first position P1.

(Operation Example of Reinforcing Bar Binding Machine 1A)

Figure 6:
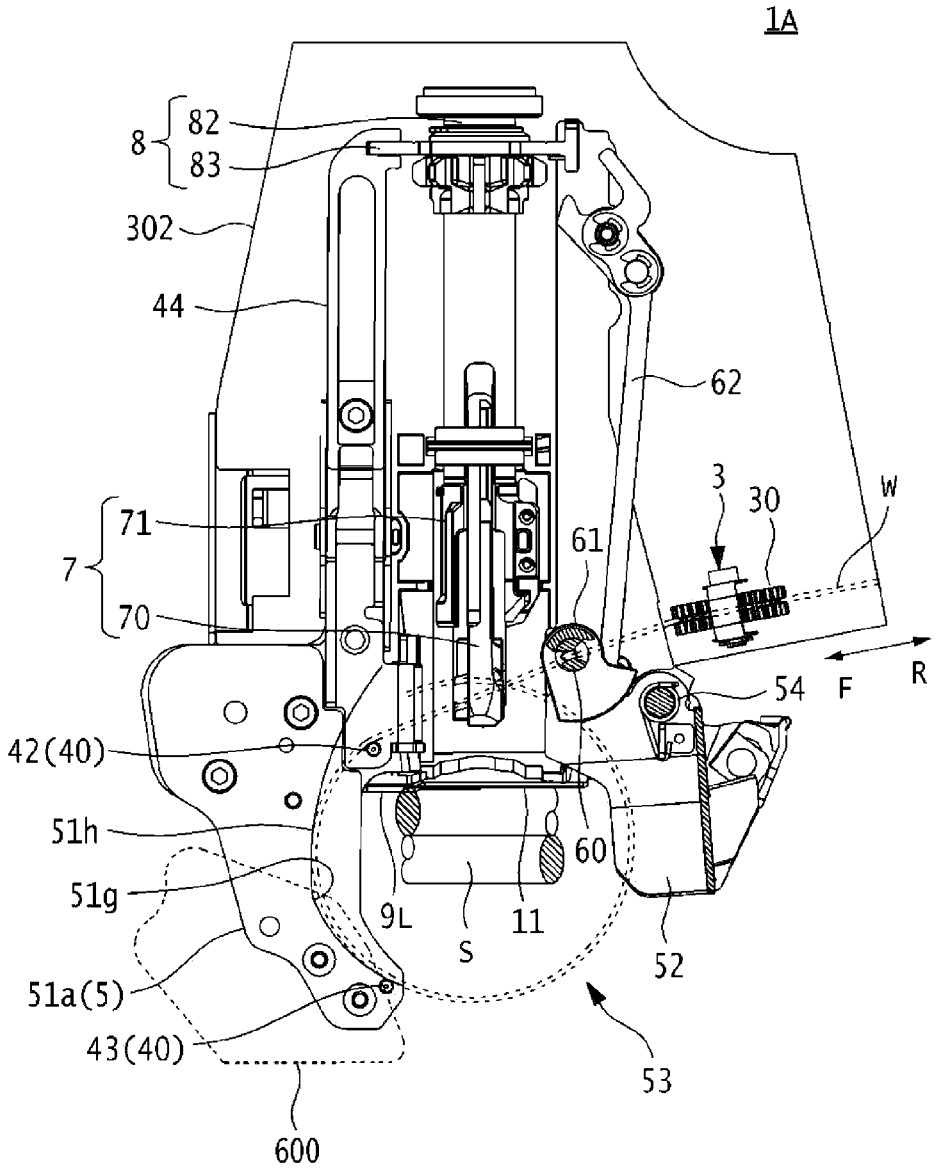
FIG. 6 shows an operation of the reinforcing bar binding machine according to the first embodiment.

Next, an operation of binding the reinforcing bar S with the wire W by the reinforcing bar binding machine 1A is described. FIG. 6 shows an example of the operation of the reinforcing bar binding machine 1A according to the first embodiment. Hereinafter, a case of performing the binding operation at an operation site where the space between the reinforcing bar S and the ground G is narrow is described with reference to FIGS. 1A to 6.

An operator grips the handle part 304*h*R and the handle part 304*h*L, takes a standing posture, and for example, aligns the guide part 5 at an intersection place of the two reinforcing bars S. Subsequently, as shown in FIG. 4B, the operator presses the tip end portion 600*a* of the induction part 600 against the ground G by an operation of moving the reinforcing bar binding machine 1A in a direction of inserting the reinforcing bars S into the insertion/pulling-out opening 53.

By the pressing operation, as shown in FIGS. 4C and 5, the tip end portion 600*a* of the induction part 600 moves toward the second body part 302 against an elastic force of the torsion coil spring 650. Specifically, the induction part 600 rotates in a direction of an arrow A4 along the long hole 610 about the pin 620 as a fulcrum, and the tip end portion 600*a* of the induction part 600 moves from the first position P1 to the second position P2. Thereby, the amount of protrusion of the induction part 600 from the tip end-side of the first guide 51 can be reduced, so that the reinforcing bars S can be inserted into the insertion/pulling-out opening 53.

As shown in FIGS. 4C and 6, when the reinforcing bars S are inserted into the insertion/pulling-out opening 53 and the reinforcing bars S are pressed against the contact member 9L by the operation of moving the reinforcing bar binding machine 1A in the direction of inserting the reinforcing bars S into the insertion/pulling-out opening 53, the contact member 9L moves to the actuating position. Along with this, the link member 96 rotates, and the second guide 52 moves from the open position to the closed position toward the first guide 51.

When the second guide 52 moves to the closed position, the feeding motor rotates in the forward direction and the feeding gears 30 rotate in the forward direction, so that the wire W is fed in the forward direction indicated by the arrow F. The wire W that is fed in the forward direction by the feeding unit 3 is bent in an arc shape by coming into contact with the fixed blade part 60, the regulation member 42, the regulation member 43 and the guide surface 51*g* of the first guide 51, so that a curl drawing a substantial circle is formed.

The wire W curled by the regulation part 40 of the first guide 51 is guided to the second guide 52 and the engaging part 70 of the twisting unit 7. When the tip end portion of the wire W is fed to a predetermined position, the feeding motor (not shown) is stopped, and the wire W is in a state of being wound around the reinforcing bars S.

After the feeding motor is stopped, the twisting motor 80 rotates in the forward direction, and the tip end-side of the wire W is held by the engaging part 70 as the actuating part 71 operates. When the wire W is held by the engaging part 70, the twisting motor 80 is stopped and the feeding motor is rotated in the reverse direction. When the feeding motor rotates in the reverse direction, the feeding gears 30 rotate in the reverse direction and the wire W is fed in the reverse direction indicated by the arrow R. Thereby, the wire W is wound to be in close contact with the reinforcing bars S.

When the wire W is wound on the reinforcing bars S, the rotation of the feeding motor is stopped, and the twisting motor 80 rotates in the forward direction. Along with this, the moving member 83 actuates the movable blade part 61 via the transmission mechanism 62, so that the wire W is cut.

After the wire W is cut, the twisting motor 80 continues to rotate in the forward direction, so that the engaging part 70 rotates and the wire W is twisted. When the wire W is bound, the twisting motor 80 is rotated in the reverse direction. Thereby, the engaging part 70 returns to an initial position, and the holding of the wire W is released. By the series of operations, the binding operation is executed.

When the binding operation is completed, the operator moves the reinforcing bar binding machine 1A in a direction of pulling out the reinforcing bars S from the insertion/pulling-out opening 53 (a direction away from the ground G). Along with this, the tip end portion 600*a* of the induction part 600 comes off from the ground G, so that, as shown in FIG. 4B, the induction part 600 is rotated in the direction of the arrow A3 about the pin 620 as a fulcrum by the urging force of the torsion coil spring 650 and the induction part 600 returns from the second position P2 to the first position P1. Further, when the force for pushing the contact member 9L by the reinforcing bars S is no longer applied by the operation of moving the reinforcing bar binding machine 1A in the direction of pulling out the reinforcing bars S from the insertion/pulling-out opening 53, the second guide 52 moves away from the first guide 51 by the urging force of the urging member 54 and returns to the open position.

According to the first embodiment, when performing the operation at a site where the space between the reinforcing bars S and the ground G is narrow, the induction part 600 is rotated by the operation of pressing the induction part 600 against the ground G. Therefore, the amount of protrusion of the induction part 600 from the tip end-side of the first guide 51 can be reduced. Thereby, the reinforcing bars S can be reliably inserted into the insertion/pulling-out opening 53 between the first guide 51 and the second guide 52, and the contact members 9L and 9R are pressed by the reinforcing bars S to securely start the binding operation.

Further, in the related art, in the case of the site where the space between the reinforcing bars S and the ground G is narrow, it was necessary to perform a replacement operation of detaching the induction part 600 from the first guide 51 so as to shorten a length of the entire guide part 5 in the direction of the axis line Ax. In contrast, according to the first embodiment, since the length of the induction part 600 with respect to the contact part 11 in the direction of the axis line Ax can be varied, the operation of replacing the induction part 600 is not necessary, so that an operation load can be reduced. In addition, it is possible to avoid the loss of components during the replacement operation of the induction part 600. Further, since a mechanism premised on replacement is not required, the induction part 600 can be firmly attached to the first guide 51.

Note that, in the above-described embodiment, when performing the operation at the site where the space between the reinforcing bars S and the ground G is narrow, the induction part 600 is pressed against the ground G, which is an obstacle, and the tip end portion 600*a* of the induction part 600 is moved from the first position P1 to the second position P2. However, at an operation site where it is not recommended to bring the induction part 600 into contact with the ground G, the operator may manually rotate the induction part 600.

For example, at an operation site where a sheet, a tape or the like for curing (hereinafter, referred to as a curing sheet or the like) is laid on concrete (ground G), when the tip end portion 600*a* of the induction part 600 is brought into contact with the curing sheet or the like, the curing sheet or the like may be damaged. For this reason, at the operation site where the curing sheet or the like is laid, it is necessary to perform the binding operation without bringing the induction part 600 into contact with the ground G.

Figure 7:
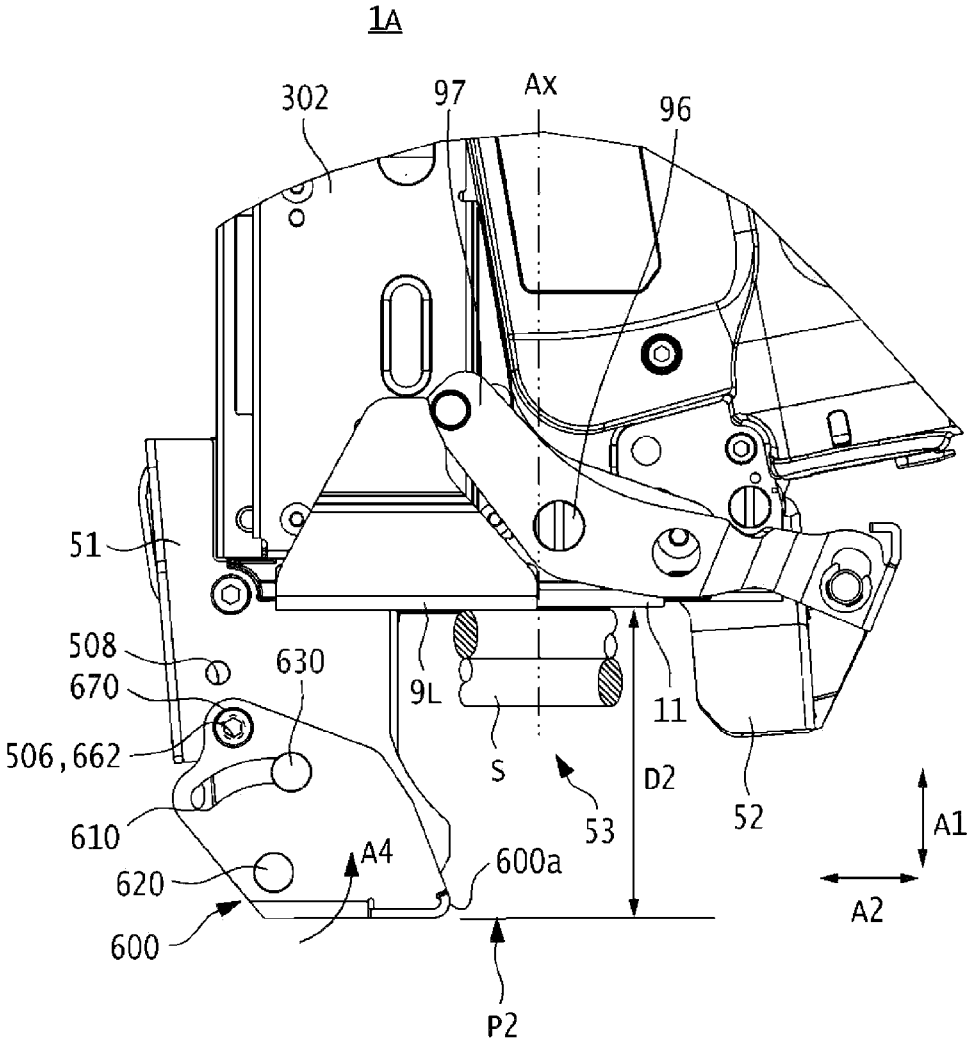
FIG. 7 is a side view of an induction part of a reinforcing bar binding machine according to a modified embodiment of the first embodiment.

FIG. 7 shows a use aspect of the induction part 600 according to a modified embodiment of the first embodiment.

When the space between the reinforcing bars S and the ground G is narrow and a curing sheet or the like is laid on the ground G such as concrete, as shown in FIG. 7, the operator rotates the tip end portion 600*a* from the first position P1 to the second position before starting the binding operation. Subsequently, the operator removes a screw 670, which is a holding member, from a hole 508 of the guide cover 51*b* (refer to FIG. 4C), and attaches the removed screw 670 to a hole 662 of the induction part 600 and a hole 506 of the guide cover 51*b* (refer to FIG. 5). Thereby, the induction part 600 is held and fixed at the second position P2. After fixing the induction part 600 at the second position P2, for example, the operator aligns the guide part 5 at the intersection place of the two reinforcing bars S, for example, and inserts the reinforcing bars S into the insertion/pulling-out opening 53, thereby performing the binding operation. In this way, by rotating the induction part 600 before the start of the binding operation, damage to the curing sheet or the like can be avoided.

Further, in the above description, the reference of the distance when the induction part 600 is varied is the contact part 11. However, for example, the drive unit 8 may be used as a reference, or the twisting motor 80 may be used as a reference. As shown in FIGS. 2A and 2B, the induction part 600 is configured to be able to vary the distance between the induction part and the twisting motor 80 provided in the second body part 302, according to the space between the reinforcing bars S, which are a binding object, and the ground G.

Specifically, in a case of performing an operation at a site where the space between the reinforcing bars S and the ground G is wide, as shown in FIG. 2A, the induction part 600 is located at the first position P1 where a distance between the tip end portion 600*a* and the motor part 80 is a first distance F1, and the amount of protrusion of the induction part 600 with respect to the first guide 51 becomes large. In contrast, in a case of performing the operation at a site where the space between the reinforcing bars S and the ground G is narrow, as shown in FIG. 2B, the induction part 600 is rotated to the second position P2 where the distance between the tip end portion 600*a* and the motor part 80 is a second distance F2 shorter than the first distance F1, and the amount of protrusion of the induction part 600 with respect to the first guide 51 becomes small.

Further, as the reference of the distance when the induction part 600 is varied, the handle parts 304*h*L and 304*h*R, which are a grip part, may be used instead of the above-described contact part 11 or the like. As shown in FIGS. 1A and 1B, the induction part 600 is configured to be able to vary the distance between the induction part and the handle parts 304*h*L and 304*h*R, which are a grip part of the first body part 301, according to the space between the reinforcing bars S, which are a binding object, and the ground G.

Specifically, in a case of performing an operation at a site where the space between the reinforcing bars S and the ground G is wide, as shown in FIG. 1A, the induction part 600 is located at the first position P1 where a distance between the tip end portion 600*a* and the handle parts 304*h*L and 304*h*R is a first distance E1, and the amount of protrusion of the induction part 600 with respect to the first guide 51 becomes large. In contrast, in a case of performing the operation at a site where the space between the reinforcing bars S and the ground G is narrow, as shown in FIG. 1B, the induction part 600 is rotated to the second position P2 where the distance between the tip end portion 600*a* and the handle parts 304*h*L and 304*h*R is a second distance E2 shorter than the first distance E1, and the amount of protrusion of the induction part 600 with respect to the first guide 51 becomes small.

Further, as the reference of the distance when the induction part 600 is varied, a tip end portion 51*a*1 of the guide arm 51*a*, which is a first guide, may be used instead of the above-described contact part 11 or the like. As shown in FIGS. 4A and 4C, the induction part 600 is configured to be able to vary the distance between the induction part and the tip end portion 51*a*1 of the guide arm 51*a*, which is provided to the second body part 302, according to the space between the reinforcing bars S, which are a binding object, and the ground G.

Specifically, in a case of performing an operation at a site where the space between the reinforcing bars S and the ground G is wide, as shown in FIG. 4A, the induction part 600 is located at the first position P1 where a distance between the tip end portion 600*a* and the tip end portion 51*a*1 of the guide arm 51*a* is a first distance H1, and the amount of protrusion of the induction part 600 with respect to the first guide 51 becomes large. In contrast, in a case of performing the operation at a site where the space between the reinforcing bars S and the ground G is narrow, as shown in FIG. 4C, the induction part 600 is rotated to the second position P2 where the distance between the tip end portion 600*a* and the tip end portion 51*a*1 of the guide arm 51*a* is a second distance H2 shorter than the first distance H1, and the amount of protrusion of the induction part 600 with respect to the first guide 51 becomes small.

Second Embodiment

An induction part 700 of a reinforcing bar binding machine 1B according to a second embodiment is different from the induction part 600 of the reinforcing bar binding machine 1A according to the first embodiment, in that the induction part 700 is configured to be movable substantially parallel to the axis line Ax. In the second embodiment, as for the configuration and operation common to the first embodiment, the overlapping descriptions are omitted by quoting the descriptions of the first embodiment.

(Configuration Example of Induction Part 700)

Figure 8A:
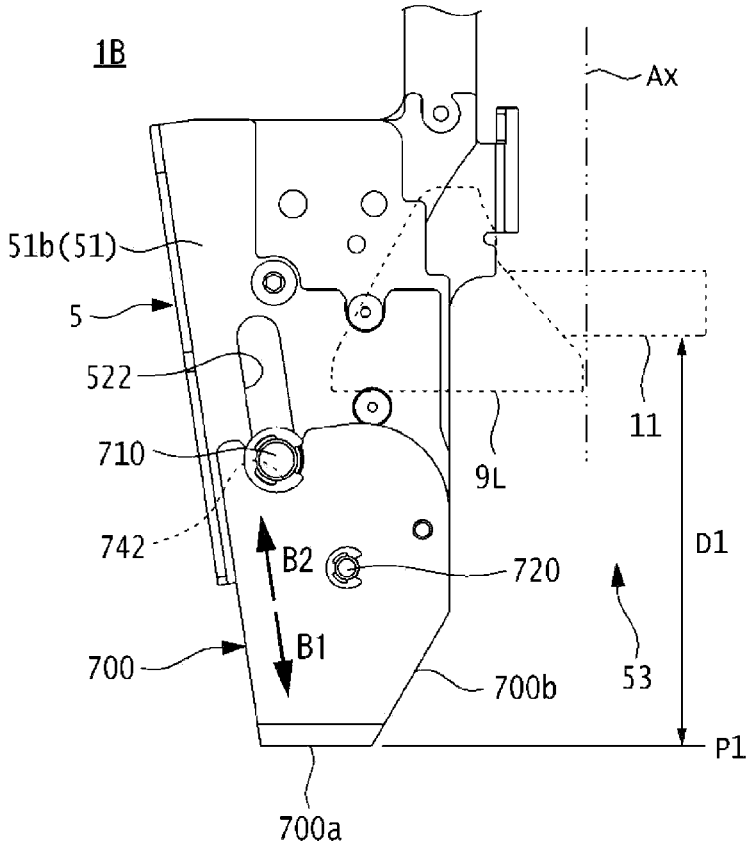
FIG. 8A is a side view of an induction part of a reinforcing bar binding machine according to a second embodiment.
Figure 8B:
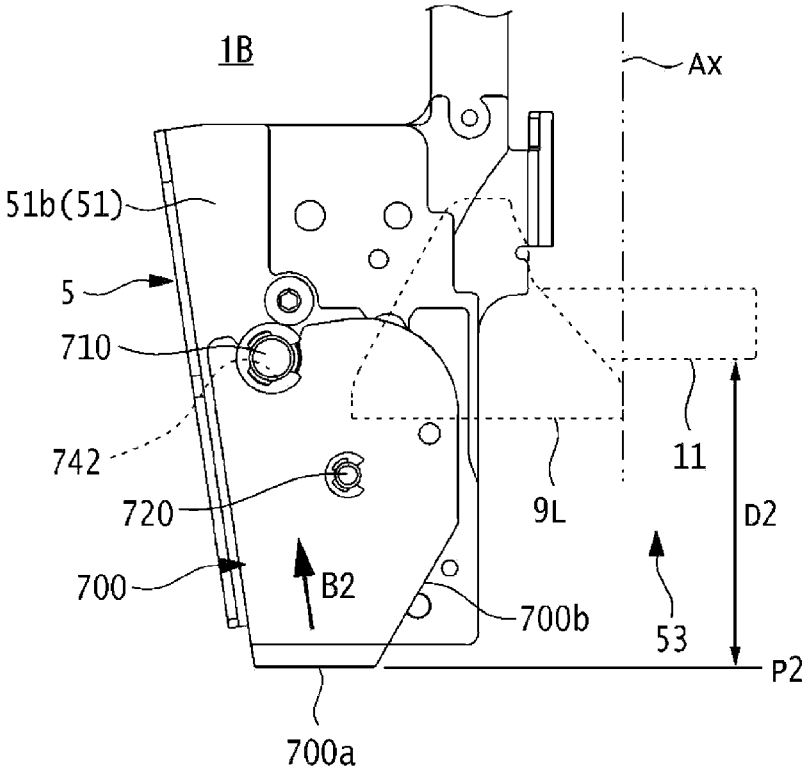
FIG. 8B is a side view of the induction part of the reinforcing bar binding machine according to the second embodiment.
Figure 9:
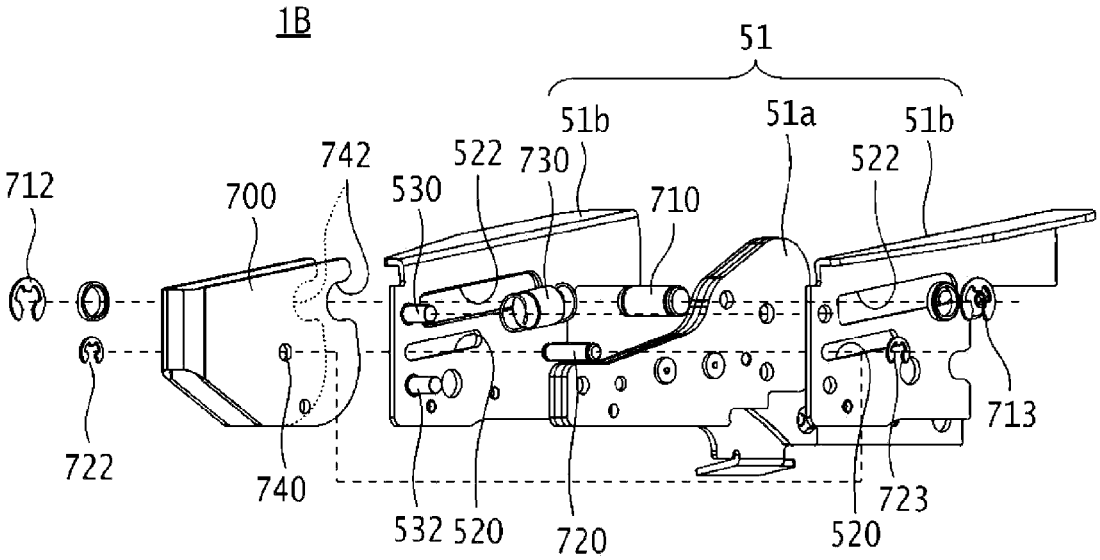
FIG. 9 is an exploded perspective view of the induction part of the reinforcing bar binding machine according to the second embodiment.

FIGS. 8A to 8B are side views showing an example of a configuration of an induction part 700 according to the second embodiment. FIG. 9 is an exploded perspective view of the induction part 700 according to the second embodiment.

As shown in FIG. 8A and the like, the induction part 700 is provided on the tip end-side of the first guide 51, and is configured to pick up the reinforcing bar S to be bound, and to induce and guide the same into the insertion/pulling-out opening 53 between the first guide 51 and the second guide 52. The induction part 700 has a tip end portion 700*a* provided to be in contact with the ground G, and an induction surface 700*b* provided on a side facing the second guide 52. The induction surface 700*b* is inclined so that the opening width of the insertion/pulling-out opening 53 becomes wider from the base end-side toward the tip end-side of the induction part 700, and has such a shape that it is easy to pick up the reinforcing bar S.

Further, the induction part 700 is configured to slide substantially parallel to the axis line Ax as the tip end portion 700*a* presses against the ground G and to vary an amount of protrusion with respect to the first guide 51 when performing an operation at a site where a space between the ground G, which is an obstacle, and the reinforcing bar S is narrow. That is, the induction part 700 is configured so that a distance between the induction part and the contact part 11 of the second body part 302 can be varied according to the space between the reinforcing bar S, which is a binding object, and the ground G.

Specifically, in a case of performing an operation at a site where the space between the reinforcing bar S and the ground G is wide, as shown in FIG. 8A, the induction part 700 is located at the first position P1 where a distance between the tip end portion 700*a* and the contact part 11 is a first distance D1, and the amount of protrusion of the induction part 700 with respect to the first guide 51 becomes large. In contrast, in a case of performing the operation at a site where the space between the reinforcing bar S and the ground G is narrow, as shown in FIG. 8B, the tip end portion 700*a* of the induction part 700 is pressed against the ground G, so that the induction part 700 is slid to the second position P2 where the distance between the tip end portion 700*a* and the contact part 11 is a second distance D2 shorter than the first distance D1, and the amount of protrusion of the induction part 700 with respect to the first guide 51 becomes small.

As shown in FIG. 9, the induction part 700 is constituted by, for example, a pair of flat plates arranged to face each other, and is fitted to outer sides of guide covers 51*b* and 51*b*. The guide covers 51*b* and 51*b* are, for example, a pair of flat plates arranged to face each other, for example, and are connected by pins 530 and 532 via the guide arm 51*a*. Note that, the guide arm 51*a* and the guide covers 51*b* constitute the first guide 51.

The guide covers 51*b* and 51*b* are each formed with a first long hole 522 and a second long hole 520 for movably supporting the induction part 700 between the first position P1 and the second position P2, respectively. The first long hole 522 and the second long hole 520 are formed substantially parallel to the axis line Ax and aligned side by side in the front and rear direction, and are configured to regulate the moving range of the guide part 700 between the first position P1 and the second position P2.

A pin 720 is inserted into a hole 740 of the induction part 700 and the second long holes 520 of the guide covers 51*b* and 51*b*, from one side toward the other side. Stoppers 722 and 723 for preventing the pin 720 from coming off in the axial direction are attached to each of both end portions of the pin 720.

A pin 710 is inserted into the first long holes 522 of the guide covers 51*b* and 51*b*, from one side toward the other side. A portion of the pin 710 exposed outward from the guide cover 51*b* is engaged (fitted) with a concave portion 742 of the induction part 700. Stoppers 712 and 713 for preventing the pin 710 from coming off in the axial direction are attached to each of both end portions of the pin 710 inserted into the first long holes 522.

A tension spring 730 is provided between the guide covers 51*b* and 51*b*. One end portion of the tension spring 730 is attached to the pin 710 and the other end portion of the tension spring 730 is attached to the pin 530. Thereby, as shown in FIGS. 8A and 9, the pin 710 is urged by the tension spring 730 in a direction of an arrow B1 on an opposite side to the contact member 9L, and the induction part 700 engaged with the pin 710 is held at the first position P1 by being pressed in the direction of the arrow B1.

(Operation Example of Induction Part 700)

Next, an example of an operation of the induction part 700 according to the second embodiment is described. Note that, in a usual state, as shown in FIG. 8A, the induction part 700 is located at the first position P1 by the urging force of the tension spring 730.

In a case where the space between the ground G and the reinforcing bar S is narrow and the binding operation is performed, the induction part 700 is slid from the position P1 to the second position P2 so as to reduce the amount of protrusion of the induction part 700 from the tip end-side of the first guide 51 in the direction of the axis line Ax. Specifically, the operator aligns the guide part 5 at an intersection place of the two reinforcing bars S, for example, and presses the tip end portion 700*a* of the induction part 700 against the ground G by an operation of moving the reinforcing bar binding machine 1B in a direction of inserting the reinforcing bars S into the insertion/pulling-out opening 53.

By the pressing operation, as shown in FIG. 8B, the pin 710 is urged in a direction of an arrow B2 by the concave portion 742 of the induction part 700 and the tension spring 730 is extended, so that the pin 710 moves along the first long hole 522. The induction part 700 relatively moves relative to the first guide 51 in the direction of the arrow B2 on the contact member 9L-side, and the tip end portion 700*a* moves from the first position P1 to the second position P2. Thereby, the amount of protrusion of the induction part 700 from the tip end-side of the first guide 51 in the direction of the axis line Ax can be reduced, so that the reinforcing bars S can be inserted into the insertion/pulling-out opening 53 to securely press the contact member 9L.

On the other hand, when the reinforcing bar binding machine 1B is lifted away from the ground G by the end of the binding operation of the reinforcing bars S and the tip end portion 700*a* is spaced apart from the ground G, the tension spring 730 is compressed and returns to an original state, and the pin 710 is urged in the direction of the arrow B1 (refer to FIG. 8A). Along with this, the induction part 700 relatively slides relative to the first guide 51 in the direction of the arrow B1 together with the pin 710, and the tip end portion 700*a* returns from the second position P2 to the first position P1.

According to the second embodiment, the substantially similar effects to those of the first embodiment can be obtained. Specifically, when performing the operation at a site where the space between the reinforcing bars S and the ground G is narrow, the induction part 700 is slid by the operation of pressing the induction part 700 against the ground G. Therefore, the amount of protrusion of the induction part 700 from the tip end-side of the first guide 51 can be reduced. Thereby, the reinforcing bars S can be reliably inserted into the insertion/pulling-out opening 53 between the first guide 51 and the second guide 52, and the contact members 9L and 9R can be pressed by the reinforcing bars S.

Note that, in the second embodiment, the reference of the distance when the induction part 700 is varied is the contact part 11. However, the present invention is not limited thereto, and as described in the first embodiment, the drive unit 8, the handle parts 304*h*L and 304*h*R, which are a grip part, or the tip end portion 51*a*1 of the guide arm 51*a* may be used as a reference.

Third Embodiment

An induction part 800 of a reinforcing bar binding machine 1C according to a third embodiment is different from the induction part 600 of the reinforcing bar binding machine 1A according to the first embodiment, and the like, in that the induction part 800 is configured to be manually rotatable with respect to a shaft (pin 860) provided in a direction orthogonal to the axis line Ax. Note that, in the third embodiment, as for the configuration and operation common to the first embodiment, the overlapping descriptions are omitted by quoting the descriptions of the first embodiment.

(Configuration Example of Induction Part 800)

Figure 10A:
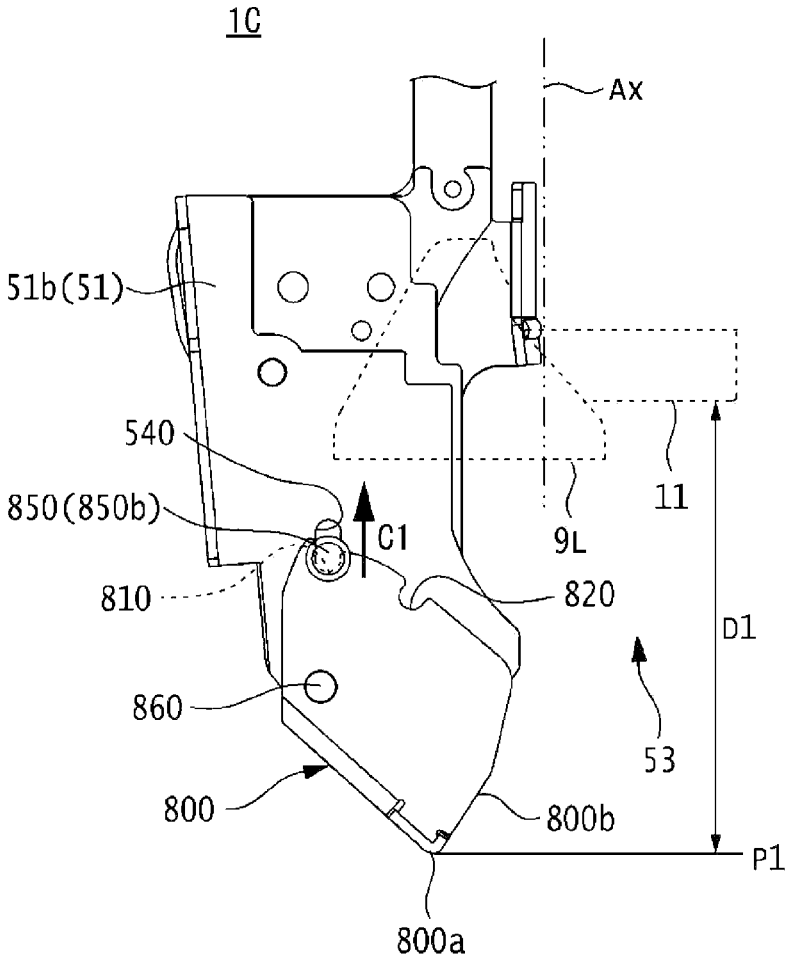
FIG. 10A is a side view of an induction part of a reinforcing bar binding machine according to a third embodiment.
Figure 10B:
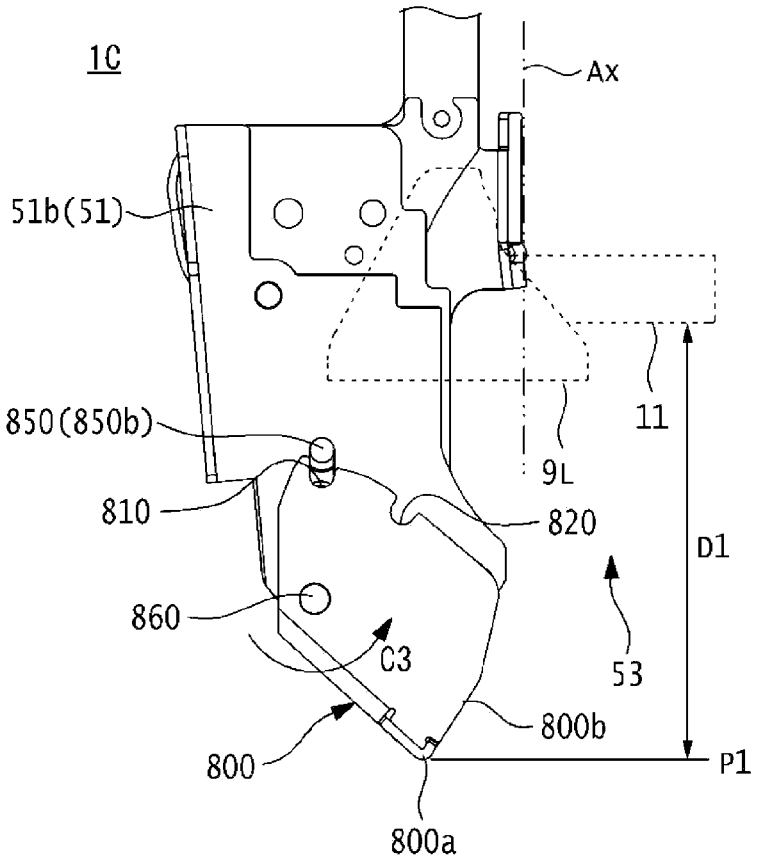
FIG. 10B is a side view of the induction part of the reinforcing bar binding machine according to the third embodiment.
Figure 10C:
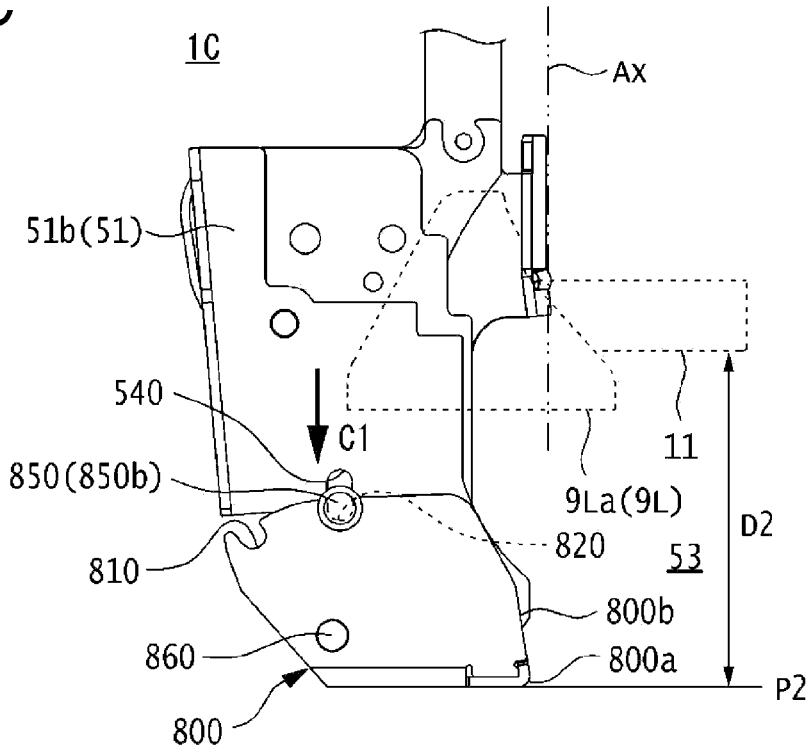
FIG. 10C is a side view of the induction part of the reinforcing bar binding machine according to the third embodiment.
Figure 11:
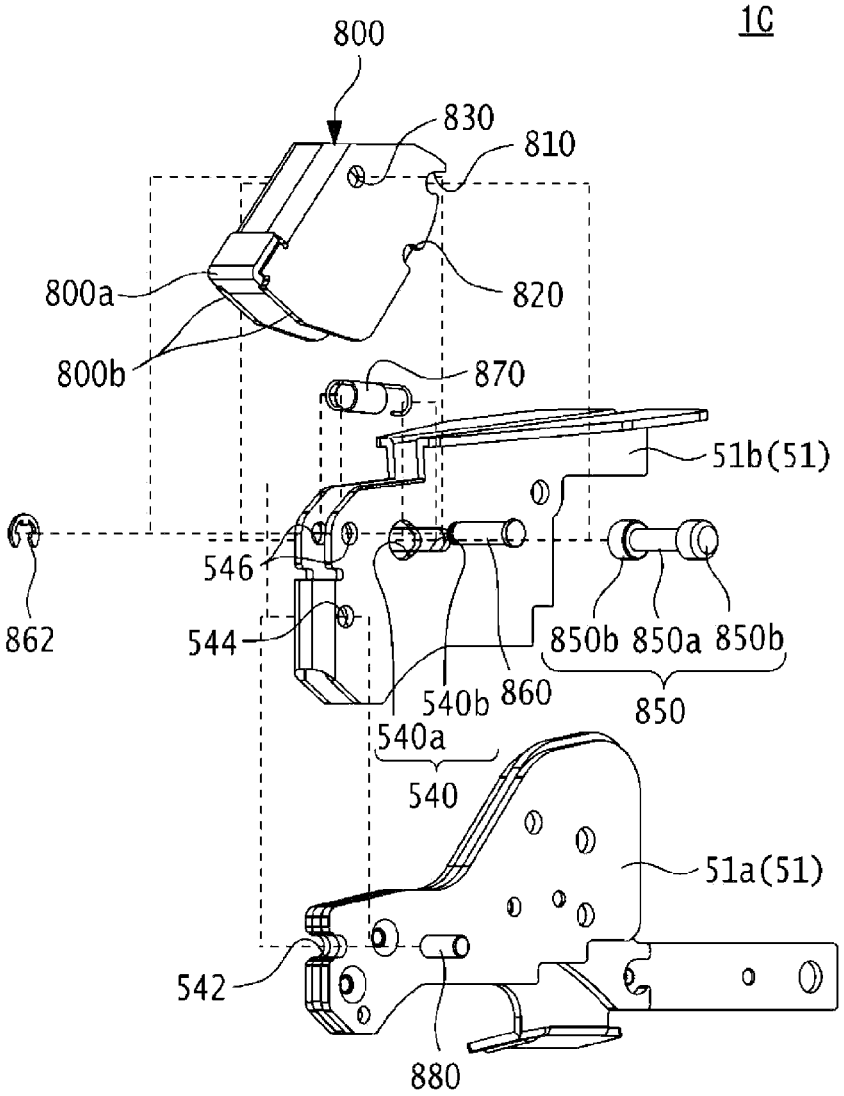
FIG. 11 is an exploded perspective view of the induction part of the reinforcing bar binding machine according to the third embodiment.

FIGS. 10A to 10C are side views showing an example of a configuration of an induction part 800 according to the third embodiment. FIG. 11 is an exploded perspective view of the induction part 800 according to the third embodiment.

As shown in FIG. 10A and the like, the induction part 800 is provided on the tip end-side of the first guide 51, and is configured to pick up the reinforcing bar S to be bound, and to induce and guide the same into the insertion/pulling-out opening 53 between the first guide 51 and the second guide 52. The induction part 800 has a tip end portion 800*a* provided to be in contact with the ground G, and an induction surface 800*b* provided on a side facing the second guide 52. The induction surface 800*b* is inclined so that the opening width of the insertion/pulling-out opening 53 becomes wider from the base end-side toward the tip end-side of the induction part 800, and has such a shape that it is easy to pick up the reinforcing bar S.

Further, the induction part 800 is configured to be able to vary an amount of protrusion with respect to the first guide 51 by the operator manually rotating the induction part 800 about a shaft (pin 860) orthogonal to the axis line Ax as a fulcrum, when performing an operation at a site where the space between the ground G, which is an obstacle, and the reinforcing bar S is narrow. That is, the induction part 800 is configured so that a distance between the induction part and the contact part 11 of the second body part 302 can be varied according to the space between the reinforcing bar S, which is a binding object, and the ground G.

Specifically, in a case of performing an operation at a site where the space between the reinforcing bar S and the ground G is wide, as shown in FIG. 10A, the induction part 800 is located at the first position P1 where a distance between the tip end portion 800*a* and the contact part 11 is a first distance D1, and the amount of protrusion of the induction part 800 with respect to the first guide 51 becomes large. In contrast, in a case of performing the operation at a site where the space between the reinforcing bar S and the ground G is narrow, as shown in FIG. 10C, the induction part 800 is rotated to the second position P2 where the distance between the tip end portion 800*a* and the motor part 11 is a second distance D2 shorter than the first distance D1, and the amount of protrusion of the induction part 800 with respect to the first guide 51 becomes small.

As shown in FIG. 11, the induction part 800 is constituted by, for example, a pair of flat plates arranged to face each other, and is fitted to the outer sides of the guide cover 51*b*. Similar to the induction part 800, the guide cover 51*b* is also constituted by, for example, a pair of flat plates arranged to face each other, and is fitted to the outer side of the guide arm 51*a*. Note that, the guide arm 51*a* and the guide cover 51*b* constitute the first guide 51.

The induction part 800 has a first engaging portion 810 that can be engaged with a pin 850 (engaged portion), which will be described later, when the induction part 800 is at the first position P1, and a second engaging portion 820 that can be engaged with the pin 850 when the induction part 800 is at the second position P2. The first engaging portion 810 and the second engaging portion 820 are formed by, for example, concave portions, and are each formed at an end edge portion of the induction part 800.

The guide cover 51*b* is formed with a long hole 540 for moving the induction part 800 to a position where an engaged state of the first engaging portion 810 and the second engaging portion 820 can be released. The long hole 540 is constituted by a first hole 540*a* having a size into which a head portion (engaged portion) 850*b* of the pin 850 can be inserted, and a second hole 540*b* for movably supporting a shaft portion 850*a* of the pin 850.

A pin 880 is inserted into a hole 544 of the guide cover 51*b*, from one side toward the other side. A portion of the pin 880 exposed inward from the guide cover 51*b* is engaged (fitted) with a concave portion 542 of the guide arm 51*a*.

A pin 860 is inserted into a hole 830 of the induction part 800 and a hole 546 of the guide cover 51*b*, from one side toward the other side. A stopper 862 for preventing the pin 860 from coming off in the axial direction is attached to the other end portion of the pin 860. Thereby, the induction part 800 is adapted to be rotatable with respect to the guide cover 51*b* with the pin 860 as a fulcrum.

The pin 850 is inserted into the long hole 540 of the guide cover 51*b*, from one side toward the other side. The shaft portion 850*a* of the pin 850 is supported to be movable along the long hole 540. The head portion 850*b* of the pin 850 is attached to the guide cover 51*b* so as to be exposed from the left and right side surfaces of the guide cover 51*b* so that the operator can grip the same.

A tension spring 870 is provided between the plates of the guide cover 51*b*. One end portion of the tension spring 870 is attached to the pin 860 and the other end portion of the tension spring 870 is attached to the pin 850. Thereby, the pin 850 is urged by the elastic force of the tension spring 870 toward the first engaging portion 810 and the second engaging portion 820 of the induction part 800, so that the engaged state of the first engaging portion 810 and the like of the induction part 800 by the pin 850 is maintained.

(Operation Example of Induction Part 800)

Next, an example of an operation of the induction part 800 according to the third embodiment is described. Note that, in a usual state, as shown in FIG. 10A, the induction part 800 is at the first position P1 as the pin 850 is engaged with the first engaging portion 810.

In a case where the space between the ground G and the reinforcing bar S is narrow and the binding operation is performed, the induction part 800 is manually rotated from the position P1 to the second position P2 so as to reduce the amount of protrusion of the induction part 800 from the tip end-side of the first guide 51 in the direction of the axis line Ax.

The operator grips the head portion 850*b* of the pin 850, and as shown in FIG. 10A, pulls the pin 850 in a direction of an arrow C1 on the contact member 9L-side of the induction part 800 against the elastic force of the tension spring 870. Thereby, the pin 850 moves in the direction of the arrow C1 along the long hole 540, and as shown in FIG. 10B, the engaged state of the first engaging portion 810 of the induction part 800 with the pin 850 is released.

Subsequently, as shown in FIGS. 10B and 10C, the operator maintains the state in which the pin 850 is pulled, i.e., the state in which the first engaging portion 810 is disengaged, and rotates the tip end portion 800*a* of the induction part 800 in a counterclockwise direction (a direction of an arrow C3) on the insertion/pulling-out opening 53-side about the pin 860 as a fulcrum.

When the second engaging portion 820 is moved to the engaging position of the pin 850, the force of separating the head portion 850*b* of the pin 850 or gripping the head portion 850*b* of the pin 850 is relaxed. Thereby, the tension spring 870 is compressed and returns to the original state, and the pin 850 moves toward the second engaging portion 820 in a direction of an arrow C2, so that the pin 850 is engaged with the second engaging portion 820. By moving the tip end portion 800*a* from the first position P1 to the second position P2 by such an operation of the operator, the amount of protrusion of the induction part 800 from the tip end-side of the first guide 51 in the direction of the axis line Ax can be reduced, and the reinforcing bar S can be inserted into the insertion/pulling-out opening 53 to reliably press the contact member 9L.

According to the third embodiment, the substantially similar effects to those of the first embodiment can be obtained. For example, when performing the operation at a site where the space between the reinforcing bar S and the ground G is narrow, the induction part 900 is manually rotated before the binding operation. Therefore, the amount of protrusion of the induction part 900 from the tip end-side of the first guide 51 can be reduced. Thereby, the reinforcing bar S can be reliably inserted into the insertion/pulling-out opening 53 between the first guide 51 and the second guide 52, and the contact members 9L and 9R can be pressed by the reinforcing bar S.

Note that, in the third embodiment, the reference of the distance when the induction part 800 is varied is the contact part 11. However, the present invention is not limited thereto, and as described in the first embodiment, the drive unit 8, the handle parts 304*h*L and 304*h*R, which are a grip part, or the tip end portion 51*a*1 of the guide arm 51*a* may be used as a reference.

Fourth Embodiment

An induction part 900 of a reinforcing bar binding machine 1D according to a fourth embodiment is different from the induction part 600 of the reinforcing bar binding machine 1A according to the first embodiment, and the like, in that the induction part 900 is configured to be manually rotatable with respect to a shaft (pin 950) provided in a direction orthogonal to the axis line Ax. Note that, in the fourth embodiment, as for the configuration and operation common to the first embodiment, the overlapping descriptions are omitted by quoting the descriptions of the first embodiment.

(Configuration Example of Induction Part 900)

Figure 12A:
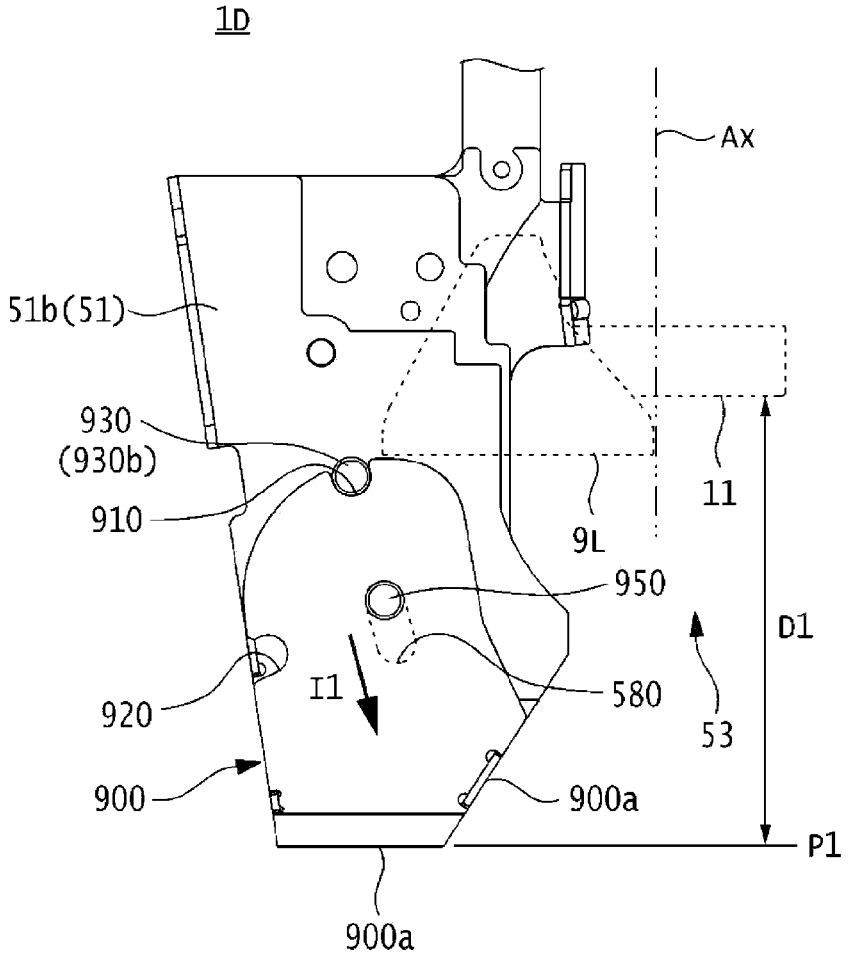
FIG. 12A is a side view of an induction part of a reinforcing bar binding machine according to a fourth embodiment.
Figure 12B:
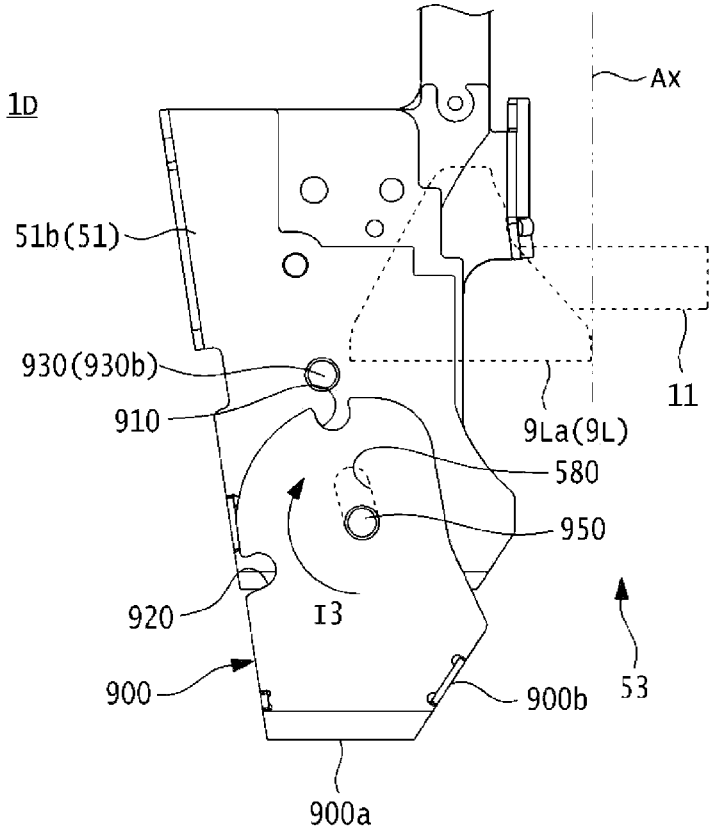
FIG. 12B is a side view of the induction part of the reinforcing bar binding machine according to the fourth embodiment.
Figure 12C:
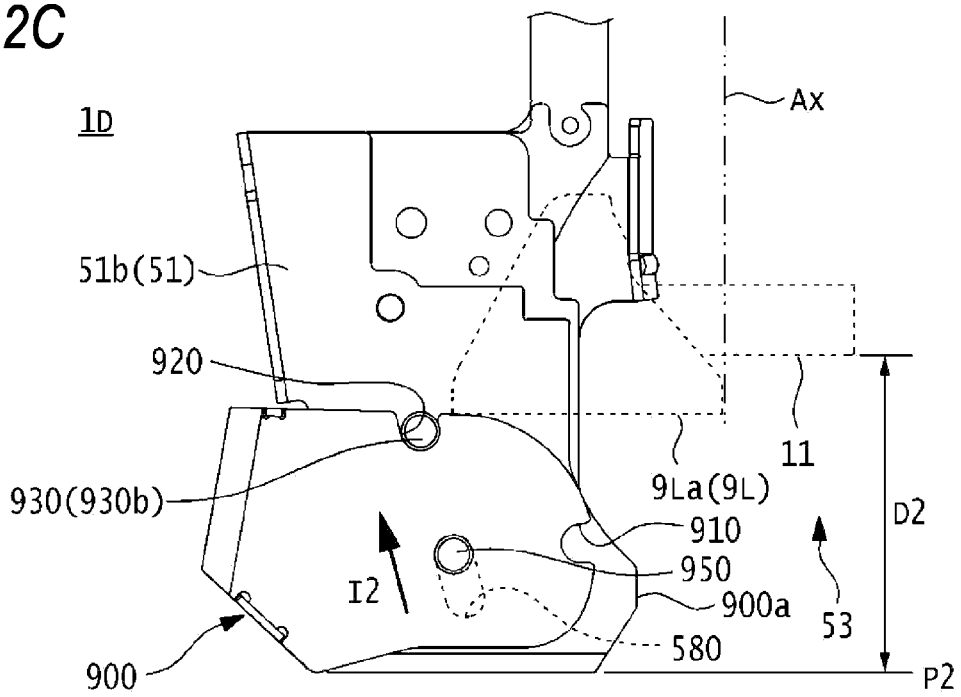
FIG. 12C is a side view of the induction part of the reinforcing bar binding machine according to the fourth embodiment.
Figure 13:
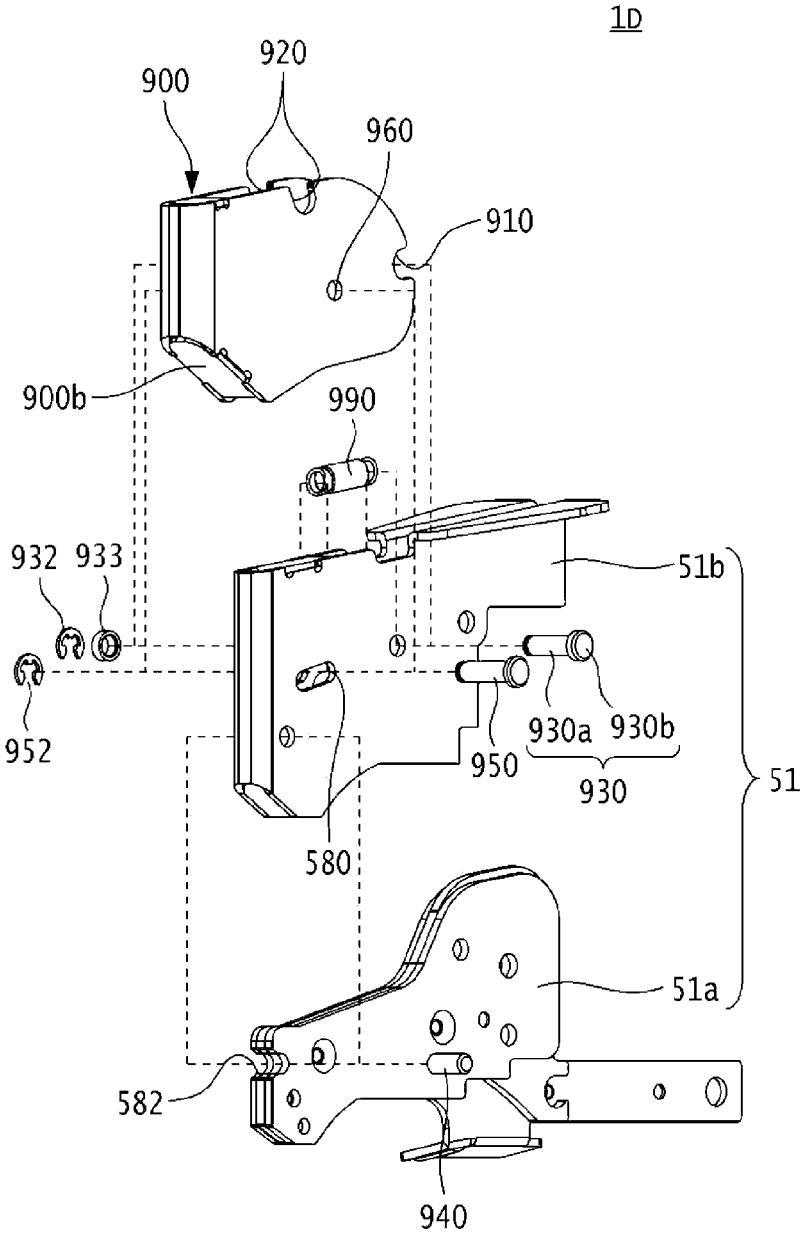
FIG. 13 is an exploded perspective view of the induction part of the reinforcing bar binding machine according to the fourth embodiment.

FIGS. 12A to 12C are side views showing an example of a configuration of an induction part 900 according to the fourth embodiment. FIG. 13 is an exploded perspective view of the induction part 900 according to the fourth embodiment.

As shown in FIG. 12A and the like, the induction part 900 is provided on the tip end-side of the first guide 51, and is configured to pick up the reinforcing bar S to be bound, and to induce and guide the same into the insertion/pulling-out opening 53 between the first guide 51 and the second guide 52. The induction part 900 has a tip end portion 900*a* provided to be in contact with the ground G, and an induction surface 900*b* provided on a side facing the second guide 52. The induction surface 900*b* is inclined so that the opening width of the insertion/pulling-out opening 53 becomes wider from the base end-side toward the tip end-side of the induction part 900, and has such a shape that it is easy to pick up the reinforcing bar S.

Further, the induction part 900 is configured to be able to vary an amount of protrusion with respect to the first guide 51 by the operator manually rotating the induction part 900 about a shaft (pin 950; which will be described later) orthogonal to the axis line Ax as a fulcrum, when performing an operation at a site where the space between the ground G, which is an obstacle, and the reinforcing bar S is narrow. That is, the induction part 900 is configured so that a distance between the induction part and the contact part 11 provided to the second body part 302 can be varied according to the space between the reinforcing bar S, which is a binding object, and the ground G.

Specifically, in a case of performing an operation at a site where the space between the reinforcing bar S and the ground G is wide, as shown in FIG. 12A and the like, the induction part 900 is located at the first position P1 where a distance between the tip end portion 900*a* and the contact part 11 is a first distance D1, and the amount of protrusion of the induction part 900 with respect to the first guide 51 becomes large. In contrast, in a case of performing the operation at a site where the space between the reinforcing bar S and the ground G is narrow, as shown in FIG. 12C, the induction part 900 is rotated to the second position P2 where the distance between the tip end portion 900*a* and the contact part 11 is a second distance D2 shorter than the first distance D1, and the amount of protrusion of the induction part 900 with respect to the first guide 51 becomes small.

As shown in FIG. 13, the induction part 900 has a first engaging portion 910 that can be engaged with a head portion (engaged portion) 930*b* formed at a pin 930 when it is at the first position P1, and a second engaging portion 920 that can be engaged with the head portion 930*b* of the pin 930 when it is at the second position P2. The first engaging portion 910 and the second engaging portion 920 are constituted by, for example, concave portions, and are each formed at an end edge portion of the induction part 900.

The guide cover 51*b* is formed with a long hole 580 for moving the induction part 800 to a position where an engaged state of the first engaging portion 810 and the second engaging portion 820 can be released. A longitudinal direction of the long hole 580 is substantially parallel to the axis line Ax.

The induction part 900 is constituted by, for example, a pair of flat plates arranged to face each other, and is fitted to the outer side of the guide cover 51*b*. Similar to the induction part 800, the guide cover 51*b* is also constituted by, for example, a pair of flat plates arranged to face each other, and is fitted to the outer side of the guide arm 51*a*.

A pin 940 is inserted into the guide cover 51*b*. A portion of the pin 940 exposed inward from the guide cover 51*b* is engaged with a concave portion 582 of the guide arm 51*a*.

The pin 930 is inserted into the guide cover 51*b*, from one side toward the other side. One end portion of the pin 930 is provided with the head portion (engaged portion) 930*b* having a diameter larger than a shaft portion. The head portion 930*b* is exposed from one side surface of the guide cover 51*b*, and can be engaged to the first engaging portion 910 and the second engaging portion 920. A stopper 932 for preventing the pin 930 from coming off is attached to the other end portion of the pin 930. In addition, the other end portion is held by a collar 933.

A pin 950 is inserted into the long hole 580 of the guide cover 51*b* and a hole 960 of the induction part 600, from one side toward the other side. A stopper 952 for preventing the pin 950 from coming off is attached to the other end portion of the pin 950. The induction part 900 is adapted to be movable between the first position P1 and the second position P2 along the long hole 580 of the guide cover 51*b* with the pin 950 as a fulcrum.

A tension spring 990 is provided between the plates of the guide cover 51*b*. One end portion of the tension spring 990 is attached to the pin 930 and the other end portion of the tension spring 990 is attached to the pin 950. Thereby, the induction part 900 is urged toward the contact member 9L (an opposite direction to an arrow I1 in FIG. 12A) by the tension spring 990, and the engaged state of the first engaging part 910 or the like with the head portion 930*b* of the pin 930 is maintained.

(Operation Example of Induction Part 900)

Next, an example of an operation of the induction part 900 according to the fourth embodiment is described. Note that, in a usual state, as shown in FIG. 12A, the induction part 900 is located at the first position P1 by the urging force of the tension spring 990.

In a case where the space between the ground G and the reinforcing bar S is narrow and the binding operation is performed, the induction part 900 is manually rotated from the position P1 to the second position P2 so as to reduce the amount of protrusion of the induction part 900 from the tip end-side of the first guide 51 in the direction of the axis line Ax.

As shown in FIG. 12A, the operator grips the left and right side surfaces of the guide part 900 with fingers, for example, and pulls the induction part 900 against the elastic force of the tension spring 990 in the direction of the arrow I1 on an opposite side to the contact member 9L. Thereby, the induction part 900 moves along the long hole 580 of the guide cover 51*b*, and as shown in FIG. 12B, the engaged state of the first engaging portion 910 of the induction part 900 with the head portion 930*b* of the pin 850 is released.

Subsequently, as shown in FIGS. 12B and 12C, the operator rotates the tip end portion 900*a* of the induction part 900 about the pin 950 as a fulcrum and in the clockwise direction (direction of an arrow 13) on an opposite side to the insertion/pulling-out opening 53, and moves the induction part to a position where the second engaging portion 920 can be engaged with the head portion 930*b* of the pin 930.

In this state, when the force of separating or gripping the induction part 900 is relaxed, as shown in FIG. 12C, the induction part 900 moves in the direction of the arrow 12 on the contact member 9L-side by the compression of the tension spring 990, and the second engaging portion 920 is engaged with the head portion 930*b* of the pin 930. By moving the tip end portion 900*a* from the first position P1 to the second position P2 by such an operation of the operator, the amount of protrusion of the induction part 900 from the tip end-side of the first guide 51 in the direction of the axis line Ax can be reduced, and the reinforcing bar S can be inserted into the insertion/pulling-out opening 53 to reliably press the contact member 9L.

According to the fourth embodiment, the substantially similar effects to those of the first embodiment can be obtained. Specifically, when performing the operation at a site where the space between the reinforcing bar S and the ground G is narrow, the induction part 900 is manually rotated before the binding operation. Therefore, the amount of protrusion of the induction part 900 from the tip end-side of the first guide 51 can be reduced. Thereby, the reinforcing bar S can be reliably inserted into the insertion/pulling-out opening 53 between the first guide 51 and the second guide 52, and the contact members 9L and 9R can be pressed by the reinforcing bar S.

Note that, in the fourth embodiment, the reference of the distance when the induction part 900 is varied is the contact part 11. However, the present invention is not limited thereto, and as described in the first embodiment, the drive unit 8, the handle parts 304*h*L and 304*h*R, which are a grip part, or the tip end portion 51*a*1 of the guide arm 51*a* may be used as a reference.

Although the embodiments of the present disclosure have been described in detail with reference to the drawings, the specific configuration is not limited to the present embodiments, and includes designs and the like within a range that does not deviate from the gist of the present disclosure. Further, the effects described in the present specification are merely exemplary and not limited, and other effects may also be obtained.

For example, in the above-described embodiments, the examples have been described in which the induction parts 600 to 900 or the like are applied to the reinforcing bar binding machine 1A and the like where the first body part 301 having a grip part such as the handle part 304*h*L and the second body part 302 having the twisting unit 7 and the like are connected by the elongated connecting part 303. However, the present invention is not limited thereto. For example, the above-described induction parts 600 to 900 or the like can be applied to a guide part of a handy type reinforcing bar binding machine having a grip part and the like provided to the second body part 302.

Further, in the above-described embodiments, the examples in which the first guide 51 is provided with the guide parts 600 to 900 have been described. However, the present invention is not limited thereto. For example, in a case where a length of the second guide 52 in the direction of the axis line Ax is longer than that of the first guide 51, and therefore, the second guide 52 first comes into contact with an obstacle such as the ground G, the above-described induction part 600 or the like may be attached to the tip end-side of the second guide 52.

Further, in the above-described embodiments, the drive unit 8 is configured to drive the cutting unit 6, the twisting unit 7 and the like. However, the driving unit 8 may also be configured to drive only the twisting unit 7, and the other configurations such as the cutting unit 6 may be driven using another drive source.

What is claimed is:

1. A binding machine comprising:

a feeding unit including at least one gear configured to feed a wire;

a guide part configured to wind the wire fed by the feeding unit around a binding object;

a twisting unit including an actuator part and an engagement part, the twisting unit configured to twist the wire wound on the binding object by the guide part; and a contact part against which the binding object is butted, wherein the guide part includes:

a first guide configured to curl the wire around the binding object butted against the contact part;

a second guide configured to guide the wire curled by the first guide to the twisting unit; and an induction part fitted to an outside of a guide cover of the guide part, the induction part including an induction surface, the induction part provided to at least one of the first guide and the second guide, and configured to guide the binding object between the first guide and the second guide, wherein the induction part is configured such that a distance between the induction part and the contact part is variable, and the induction surface is inclined so that an opening width of an insertion/pulling-out opening between the first guide and the second guide becomes wider toward a tip end-side of the induction part.

2. The binding machine according to claim 1, wherein the induction part is configured to rotate about a shaft extending in a direction substantially orthogonal to an axis line of the twisting unit, as a fulcrum.

3. The binding machine according to claim 2, wherein a tip end portion of the induction part is provided on an opening-side formed between the first guide and the second guide with respect to the shaft.

4. The binding machine according to claim 1, wherein the induction part is configured to move substantially parallel to an axis line of the twisting unit.

5. The binding machine according to claim 1, wherein the induction part is configured to be able to move to a first position where a distance between a tip end portion of the induction part and the contact part is a first distance, and a second position where the distance between the tip end portion of the induction part and the contact part is a second distance shorter than the first distance.

6. The binding machine according to claim 5, wherein the induction part comprises:

a first concavity for fixing the induction part to the first position; and a second concavity for fixing the induction part to the second position, and wherein at least one of the first guide and the second guide is provided with a pin configured to engage with the first concavity and the second concavity.

7. The binding machine according to claim 6, wherein the induction part is rotated about a shaft extending in a direction substantially orthogonal to an axis line of the twisting unit, as a fulcrum, so that the first concavity or the second concavity is caused to engage with the pin.

8. The binding machine according to claim 5, wherein the induction part is held at the second position by a holding member when the induction part is moved from the first position to the second position.

9. The binding machine according to claim 1, wherein the induction part has a tip end portion, and the tip end portion is configured to press against the ground, so that the distance between the induction part and the contact part is variable.

10. The binding machine according to claim 1, wherein the induction part is provided to one of the first guide and the second guide, and when the induction part is in a first position where an operation is performed at a site where a space between the binding object and a ground is a first size, a distance between the tip end-side of the induction part and the one of the first guide and the second guide is a first distance, and when the induction part is in a second position where an operation is performed at a site where the space between the binding object and a ground is a second size, the distance between the tip end-side of the induction part and the one of the first guide and the second guide is a second distance, wherein the first size is larger than the second size and the first distance is larger than the second distance.

11. A binding machine comprising:

a feeding unit including at least one gear configured to feed a wire;

a guide part configured to wind the wire fed by the feeding unit around a binding object;

a twisting unit including an actuator part and an engagement part, the twisting unit configured to twist the wire wound on the binding object by the guide part; and a drive unit including a twisting motor configured to drive the twisting unit, wherein the guide part includes:

a first guide configured to curl the wire around the binding object;

a second guide configured to guide the wire curled by the first guide to the twisting unit; and an induction part fitted to an outside of a guide cover of the guide part, the induction part including an induction surface, the induction part provided to at least one of the first guide and the second guide, and configured to guide the binding object between the first guide and the second guide, wherein the induction part is configured such that a distance between the induction part and the drive unit is variable, and the induction surface is inclined so that an opening width of an insertion/pulling-out opening between the first guide and the second guide becomes wider toward a tip end-side of the induction part.

12. The binding machine according to claim 11, wherein the induction part is configured to be able to move to a first position where a distance between a tip end portion of the induction part and the drive unit is a first distance, and a second position where the distance between the tip end portion of the induction part and the drive unit is a second distance shorter than the first distance.

13. The binding machine according to claim 11, comprising:

a first body part; and a second body part connected to the first body part, wherein the twisting unit and the drive unit are provided inside the second body part, the first guide and the second guide are provided at an end portion of the second body part on an opposite side to a portion of the second body part connected to the first body part, and the induction part is provided on a tip end-side of at least one of the first guide and the second guide.

14. The binding machine according to claim 11, wherein the induction part has a tip end portion, wherein the tip end portion is configured to press against the ground, so that the distance between the induction part and the drive unit is variable.

15. The binding machine according to claim 11, wherein the induction part is provided to one of the first guide and the second guide, and when the induction part is in a first position where an operation is performed at a site where a space between the binding object and a ground is a first size, a distance between the tip end-side of the induction part and the one of the first guide and the second guide is a first distance, and when the induction part is in a second position where an operation is performed at a site where the space between the binding object and a ground is a second size, the distance between the tip end-side of the induction part and the one of the first guide and the second guide is a second distance, wherein the first size is larger than the second size and the first distance is larger than the second distance.

16. A binding machine comprising:

a feeding unit including at least one gear configured to feed a wire;

a guide part configured to wind the wire fed by the feeding unit around a binding object;

a twisting unit including an actuator part and an engagement part, the twisting unit configured to twist the wire wound on the binding object by the guide part; and a grip part adapted to be gripped by an operator, wherein the guide part includes:

a first guide configured to curl the wire around the binding object;

a second guide configured to guide the wire curled by the first guide to the twisting unit; and an induction part fitted to an outside of a guide cover of the guide part, the induction part including an induction surface, the induction part provided to at least one of the first guide and the second guide, and configured to guide the binding object between the first guide and the second guide, and wherein the induction part is configured such that a distance between the induction part and the grip part is variable, and the induction surface is inclined so that an opening width of an insertion/pulling-out opening between the first guide and the second guide becomes wider toward a tip end-side of the induction part.

17. The binding machine according to claim 16, wherein the induction part has a tip end portion, wherein the tip end portion is configured to press against the ground, so that the distance between the induction part and the grip part is variable.

18. The binding machine according to claim 16, wherein the induction part is provided to one of the first guide and the second guide, and when the induction part is in a first position where an operation is performed at a site where a space between the binding object and a ground is a first size, a distance between the tip end-side of the induction part and the one of the first guide and the second guide is a first distance, and when the induction part is in a second position where an operation is performed at a site where the space between the binding object and a ground is a second size, the distance between the tip end-side of the induction part and the one of the first guide and the second guide is a second distance, wherein the first size is larger than the second size and the first distance is larger than the second distance.

19. A binding machine comprising:

a feeding unit including at least one gear configured to feed a wire;

a guide part configured to wind the wire fed by the feeding unit around a binding object; and a twisting unit including an actuator part and an engagement part, the twisting unit configured to twist the wire wound on the binding object by the guide part, wherein the guide part includes:

a first guide configured to curl the wire around the binding object;

a second guide configured to guide the wire curled by the first guide to the twisting unit; and an induction part fitted to an outside of a guide cover of the guide part, the induction part including an induction surface, the induction part provided to at least one of the first guide and the second guide, and configured to guide the binding object between the first guide and the second guide, and wherein the induction part is configured such that a distance between the induction part and a tip end portion of at least one of the first guide and the second guide is variable, and the induction surface is inclined so that an opening width of an insertion/pulling-out opening between the first guide and the second guide becomes wider toward a tip end-side of the induction part.

20. The binding machine according to claim 19, wherein the induction part has a tip end portion, wherein the tip end portion is configured to press against the ground, so that the distance between the induction part and a tip end portion of the at least one of the first guide and the second guide is variable.

21. The binding machine according to claim 19, wherein the induction part is provided to one of the first guide and the second guide, and when the induction part is in a first position where an operation is performed at a site where a space between the binding object and a ground is a first size, a distance between the tip end-side of the induction part and the one of the first guide and the second guide is a first distance, and when the induction part is in a second position where an operation is performed at a site where the space between the binding object and a ground is a second size, the distance between the tip end-side of the induction part and the one of the first guide and the second guide is a second distance, wherein the first size is larger than the second size and the first distance is larger than the second distance.

* * * * *